US010066274B2

(12) United States Patent
Kasuya et al.

(10) Patent No.: US 10,066,274 B2
(45) Date of Patent: Sep. 4, 2018

(54) HIGH-STRENGTH STEEL SHEET HAVING EXCELLENT DUCTILITY AND LOW-TEMPERATURE TOUGHNESS, AND METHOD FOR PRODUCING SAME

(71) Applicant: KABUSHIKI KAISHA KOBE SEIKO SHO (KOBE STEEL, LTD.), Kobe-shi (JP)

(72) Inventors: Koji Kasuya, Kakogawa (JP); Tadao Murata, Kakogawa (JP); Sae Mizuta, Kakogawa (JP); Yuichi Futamura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 348 days.

(21) Appl. No.: 15/023,520

(22) PCT Filed: Sep. 25, 2014

(86) PCT No.: PCT/JP2014/075445
§ 371 (c)(1),
(2) Date: Mar. 21, 2016

(87) PCT Pub. No.: WO2015/046339
PCT Pub. Date: Apr. 2, 2015

(65) Prior Publication Data

US 2016/0208359 A1 Jul. 21, 2016

(30) Foreign Application Priority Data

Sep. 27, 2013 (JP) ..... 2013-202536
Mar. 31, 2014 (JP) ..... 2014-071907

(51) Int. Cl.
*C22C 38/02* (2006.01)
*C22C 38/04* (2006.01)
(Continued)

(52) U.S. Cl.
CPC ..... *C21D 9/46* (2013.01); *C21D 8/0205* (2013.01); *C21D 8/0247* (2013.01); *C22C 38/00* (2013.01);
(Continued)

(58) Field of Classification Search
None
See application file for complete search history.

(56) References Cited

U.S. PATENT DOCUMENTS

2005/0161134 A1 7/2005 Ikeda et al.
2008/0251161 A1 10/2008 Kashima et al.
(Continued)

FOREIGN PATENT DOCUMENTS

EP 2 695 961 A1 2/2014
GB 2 452 230 A 3/2009
(Continued)

OTHER PUBLICATIONS

Extended European Search Report dated Feb. 8, 2017 in Patent Application No. 14848596.4.
(Continued)

*Primary Examiner* — Deborah Yee
(74) *Attorney, Agent, or Firm* — Oblon, McClelland, Maier & Neustadt, L.L.P.

(57) ABSTRACT

A high-strength steel sheet of the present invention is a steel sheet satisfying a predetermined component composition. A metal structure of the steel sheet is composed of polygonal ferrite, high-temperature region generated bainite, low-temperature region generated bainite and retained austenite each having a predetermined area percent, and a distribution using each average IQ of predetermined crystal grains determined by electron backscatter diffraction satisfies Equations (1) and (2) below. According to the present invention, a high-strength steel sheet having excellent duc-
(Continued)

tility and low-temperature toughness can be realized even at a tensile strength of 780 MPa or more.

$$(IQave-IQmin)/(IQmax-IQmin)\geq 0.40 \quad (1)$$

$$(\sigma IQ)/(IQmax-IQmin)\leq 0.25 \quad (2)$$

9 Claims, 6 Drawing Sheets

(51) Int. Cl.

| | |
|---|---|
| ***C22C 38/06*** | (2006.01) |
| ***C21D 8/02*** | (2006.01) |
| ***C21D 9/46*** | (2006.01) |
| ***C22C 38/00*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |
| ***C22C 38/18*** | (2006.01) |
| ***C23C 2/02*** | (2006.01) |
| ***C23C 2/28*** | (2006.01) |
| ***C23C 2/06*** | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/38* (2013.01); *C23C 2/02* (2013.01); *C23C 2/06* (2013.01); *C23C 2/28* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 2010/0172786 | A1 | 7/2010 | Nakaya et al. | |
| 2010/0221138 | A1 | 9/2010 | Nakaya et al. | |
| 2011/0146852 | A1 | 6/2011 | Matsuda et al. | |
| 2012/0312433 | A1 | 12/2012 | Mizuta et al. | |
| 2013/0133786 | A1 | 5/2013 | Matsuda et al. | |
| 2014/0044988 | A1 | 2/2014 | Futamura et al. | |
| 2014/0205855 | A1 | 7/2014 | Kawata et al. | |
| 2014/0242416 | A1 | 8/2014 | Matsuda et al. | |
| 2015/0101712 | A1 | 4/2015 | Futamura et al. | |
| 2016/0237520 | A1 * | 8/2016 | Murata ..... | C21D 9/46 |
| 2016/0355920 | A1 | 12/2016 | Futamura et al. | |

FOREIGN PATENT DOCUMENTS

| | | | |
|---|---|---|---|
| JP | 1-230715 | A | 9/1989 |
| JP | 11-21653 | A | 1/1999 |
| JP | 11-50197 | A | 2/1999 |
| JP | 2001-329340 | A | 11/2001 |
| JP | 2005-240178 | A | 9/2005 |
| JP | 2006-274417 | A | 10/2006 |
| JP | 2007-321236 | A | 12/2007 |
| JP | 2007-321237 | A | 12/2007 |
| JP | 2010-90475 | A | 4/2010 |
| JP | 2010-196115 | A | 9/2010 |
| JP | 2011-33600 | A | 2/2011 |
| JP | 2011-184757 | A | 9/2011 |
| JP | 2012-214868 | A | 11/2012 |
| JP | 2012-214869 | A | 11/2012 |
| JP | 2013-19047 | A | 1/2013 |
| JP | 2013-72101 | A | 4/2013 |
| JP | 2013-227653 | A | 11/2013 |
| WO | 2013/018740 | A1 | 2/2013 |
| WO | WO 2013/051238 | A1 | 4/2013 |

OTHER PUBLICATIONS

International Search Report dated Dec. 22, 2014, in PCT/JP2014/075445 Filed Sep. 25, 2014.

International Preliminary Report of Patentability and Written Opinion dated Apr. 7, 2016 in PCT/JP2014/075445 (English translation only).

* cited by examiner

HIGH-STRENGTH STEEL SHEET HAVING EXCELLENT DUCTILITY AND LOW-TEMPERATURE TOUGHNESS, AND METHOD FOR PRODUCING SAME

TECHNICAL FIELD

The present invention relates to a high-strength steel sheet having a tensile strength of 780 MPa or more and having excellent ductility and low-temperature toughness and a method for producing the same.

BACKGROUND ART

In the field of automotive vehicles, it is an urgent need to address global environmental problems such as regulations on $CO_2$ emission. On the other hand, in terms of ensuring passenger safety, collision safety standards of automotive vehicles have been reinforced and a structure design capable of sufficiently ensuring safety in a boarding space is in progress. To simultaneously achieve these requests, it is effective to use a high-strength steel sheet having a tensile strength of 780 MPa or more as a structure member of an automotive vehicle and reduce the weight of a vehicle body by further thinning this high-strength steel sheet. However, since processability is deteriorated if the strength of a steel sheet is increased, an improvement of processability is an unavoidable problem in applying the above high-strength steel sheet to an automotive member.

TRIP (Transformation Induced Plasticity) steel sheets are known as steel sheets having both strength and processability. As one type of TRIP steel sheets, TBF (TRIP aided bainitic ferrite) steel sheets whose parent phase is bainitic ferrite and which contain retained austenite (hereinafter, written as "retained γ" in some cases) are known, for example, as disclosed in patent literatures 1 to 4. In TBF steel sheets, high strength is obtained by hard bainitic ferrite and good elongation (EL) and stretch flange formability (λ) are obtained by fine retained γ present on boundaries of bainitic ferrite.

In addition to the above properties, an improvement of low-temperature toughness is desired for a collision safety improvement at low temperatures. However, TRIP steel sheets are known to be inferior in low-temperature toughness and low-temperature toughness has not been considered at all thus far.

CITATION LIST

Patent Literature

Patent literature 1: Japanese Unexamined Patent Publication No. 2005-240178

Patent literature 2: Japanese Unexamined Patent Publication No. 2006-274417

Patent literature 3: Japanese Unexamined Patent Publication No. 2007-321236

Patent literature 4: Japanese Unexamined Patent Publication No. 2007-321237

SUMMARY OF INVENTION

The present invention was developed in view of the situation as described above and aims to provide a high-strength steel sheet having a tensile strength of 780 MPa or more and having good ductility and excellent low-temperature toughness and a method for producing the same.

The present invention capable of solving the above problem is directed to a high-strength steel sheet having excellent ductility and low-temperature toughness and consisting of, in mass %, C: 0.10 to 0.5%, Si: 1.0 to 3.0%, Mn: 1.5 to 3%, Al: 0.005 to 1.0%, P: more than 0% and not more than 0.1%, S: more than 0% and not more than 0.05%, with the balance being iron and inevitable impurities, wherein a metal structure of the steel sheet containing polygonal ferrite, bainite, tempered martensite and retained austenite, and satisfying:

(1) when the metal structure is observed by a scanning electron microscope, (1a) an area percent a of the polygonal ferrite to the entire metal structure is 10 to 50%;

(1b) the bainite is composed of a composite structure of high-temperature region generated bainite in which an average interval of distances between center positions of adjacent retained austenite grains, of adjacent carbide grains and of adjacent retained austenite grains and carbide grains is 1 μm or longer and low-temperature region generated bainite in which an average interval of distances between center positions of adjacent retained austenite grains, of adjacent carbide grains and of adjacent retained austenite grains and carbide grains is shorter than 1 μm:

an area percent b of the high-temperature region generated bainite to the entire metal structure satisfies higher than 0% and not higher than 80%, and a total area percent c of the low-temperature region generated bainite and the tempered martensite to the entire metal structure satisfies higher than 0% and not higher than 80%;

(2) a volume percent of the retained austenite measured by a saturation magnetization method to the entire metal structure is 5% or higher;

(3) when an area enclosed by a boundary in which an orientation difference measured by electron backscatter diffraction (EBSD) is 3° or larger is defined as a crystal grain, a distribution using each average IQ (Image Quality) based on the visibility of an EBSD pattern of the crystal grain analyzed for each crystal grain of a body centered cubic lattice (including a body centered tetragonal lattice) satisfies Equations (1) and (2) below:

$$(IQave-IQmin)/(IQmax-IQmin)\geq 0.40 \quad (1)$$

$$(\sigma IQ)/(IQmax-IQmin)\leq 0.25 \quad (2)$$

(wherein IQave denotes an average value of average IQ total data of each crystal grain, IQmin denotes a minimum value of average IQ total data of each crystal grain, IQmax denotes a maximum value of average IQ total data of each crystal grain, and σIQ denotes a standard deviation of the average IQ total data of each crystal grain).

In the present invention, it is also a preferred embodiment that the area percent b of the high-temperature region generated bainite to the entire metal structure satisfies 10 to 80% and the total area percent c of the low-temperature region generated bainite and the tempered martensite to the entire metal structure satisfies 10 to 80%.

Further, in the present invention, it is also a preferred embodiment that, if MA mixed phases in which quenched martensite and retained austenite are compounded are present when the metal structure is observed by an optical microscope, a number ratio of the MA mixed phases having a circle-equivalent diameter d satisfying 7 μm or larger to the total number of the MA mixed phases is higher than 0% and below 15%.

Furthermore, it is also a preferred embodiment that an average circle-equivalent diameter D of the polygonal ferrite grains is larger than 0 μm and not larger than 10 μm.

Further, the steel sheet of the present invention preferably contains at least one of the following (a) to (e):

(a) one or more elements selected from a group consisting of Cr: more than 0% and not more than 1% and Mo: more than 0% and not more than 1%, (b) one or more elements selected from a group consisting of Ti: more than 0% and not more than 0.15%, Nb: more than 0% and not more than 0.15% and V: more than 0% and not more than 0.15%, (c) one or more elements selected from a group consisting of Cu: more than 0% and not more than 1% and Ni: more than 0% and not more than 1%, (d) B: more than 0% and not more than 0.005%, and (e) one or more elements selected from a group consisting of Ca: more than 0% and not more than 0.01%, Mg: more than 0% and not more than 0.01% and rare-earth elements: more than 0% and not more than 0.01%.

Further, it is also preferred that a surface of the steel sheet includes an electro-galvanized layer, a hot dip galvanized layer or an alloyed hot dip galvanized layer.

Further, the present invention also encompasses a method for producing the above high-strength steel sheet, the method including:

heating a steel sheet satisfying the component composition to a temperature region of 800° C. or higher and an $Ac_3$ point—10° C. or lower;

soaking the steel sheet in this temperature region for 50 seconds or longer, then cooling the steel sheet at an average cooling rate of 10° C./s or higher up to an arbitrary temperature T satisfying 150° C. or higher and 400° C. or lower (an Ms point or lower if the Ms point expressed by Equation below is 400° C. or lower) and holding the steel sheet in a T1 temperature region satisfying Equation (3) below for 10 to 200 seconds; and subsequently heating the steel sheet to a T2 temperature region satisfying Equation (4) below and cooling the steel sheet after holding the steel sheet in this temperature region for 50 seconds or longer:

$$150° \text{ C.} \leq T1(° \text{ C.}) \leq 400° \text{ C.} \quad (3),$$

$$400° \text{ C.} < T2(° \text{ C.}) \leq 540° \text{ C.} \quad (4),$$

$$\text{Ms point } (° \text{ C.}) = 561 - 474 \times [C]/(1 - Vf/100) - 33 \times [Mn] - 17 \times [Ni] - 17 \times [Cr] - 21 \times [Mo]$$

wherein Vf denotes a ferrite fraction measurement value in a sample replicating an annealing pattern from heating, soaking to cooling which is separately fabricated, and [ ] in Equation indicates a content (mass %) of each element and the content of the element not contained in the steel sheet is calculated as 0 mass %.

Furthermore, the producing method of the present invention includes cooling and, subsequently, electro-galvanizing, hot dip galvanizing or alloyed hot dip galvanizing applied after the steel sheet is held in the temperature region satisfying the Equation (4) or hot dip galvanizing or alloyed hot dip galvanizing applied in the temperature region satisfying the Equation (4).

Effects of Invention

According to the present invention, after polygonal ferrite is so generated that the area percent to the entire metal structure satisfies 10 to 50%, both bainite generated in a low temperature region and tempered martensite (hereinafter, written as "low-temperature region generated bainite and the like" in some cases) and bainite generated in a high temperature region (hereinafter, written as "high-temperature region generated bainite" in some cases) are generated and the IQ (Image Quality) distribution of each crystal grain of a body centered cubic (BCC) lattice crystal (including a body centered tetragonal (BCT) lattice crystal. The same applies to the following) measured by electron backscatter diffraction (EBSD) is controlled to satisfy Equations (1) and (2), whereby a high-strength steel sheet having both excellent ductility and low-temperature toughness can be realized even at a high strength region of 780 MPa or more. Further, according to the present invention, a method for producing the high-strength steel sheet can be provided.

DESCRIPTION OF EMBODIMENT

Figure 1:
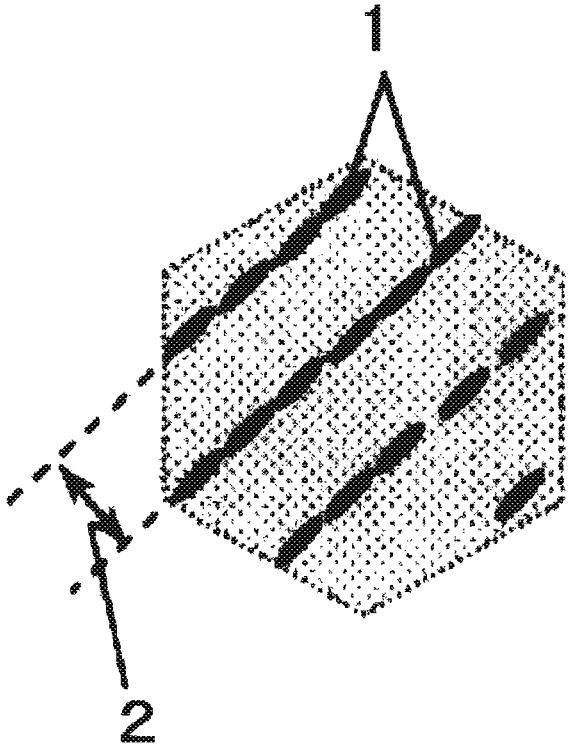
FIG. 1 is a diagram showing an example of an average interval between adjacent retained austenite grains and/or carbide grains.

The present inventors studied in depth to improve the ductility and low-temperature toughness of a high-strength steel sheet having a tensile strength of 780 MPa or more. As a result, they found the following and completed the present invention.

(1) A high-strength steel sheet having excellent elongation can be provided if a metal structure of a steel sheet is made a mixed structure containing polygonal ferrite, bainite, tempered martensite and retained austenite each having a predetermined ratio and, particularly the following two types of bainite are generated as bainite:

(1a) high-temperature region generated bainite in which an average interval of distances between center positions of adjacent retained γ gains, of adjacent carbide grains or of adjacent retained γ grains and carbide grains (hereinafter, these are collectively referred to as "retained γ grains and the like" in some cases) is 1 μm or longer, and (1b) low-temperature region generated bainite in which an average interval of distances between center positions of retained γ grains and the like is shorter than 1 μm.

(2) Further, a high-strength steel sheet having excellent low-temperature toughness can be provided by controlling such that an IQ distribution of each crystal grain of a body centered cubic lattice (including a body centered tetragonal lattice) satisfies relationships of Equation (1) [(IQave−IQmin)/(IQmax−IQmin)≥0.40] and Equation (2) [(σIQ)/(IQmax−IQmin)≤0.25].

(3) In order to generate a predetermined amount of polygonal ferrite, bainite, tempered martensite and retained austenite described above and realize a predetermined IQ distribution satisfying the above Equations (1) and (2), a steel sheet satisfying a predetermined component composition is heated to a two-phase temperature region of 800° C. or higher and an $Ac_3$ point—10° C. or lower and soaked by being held in this temperature region for 50 seconds or longer, then cooled at an average cooling rate of 10° C./s or higher up to an arbitrary temperature T satisfying 150° C. or higher and 400° C. or lower (an Ms point or lower if the Ms point is 400° C. or lower) and held in a T1 temperature region satisfying Equation (3) [150° C.≤T3 (° C.)≤400° C.] for 10 to 200 seconds, then heated to a T2 temperature region satisfying Equation (4) [400° C.<T2 (° C.)≤540° C.] and held in this temperature region for 50 seconds or longer.

The high-strength steel sheet according to the present invention is described below. First, an IQ (Image Quality) distribution of the high-strength steel sheet is described.

[IQ Distribution]

In the present invention, an area enclosed by a boundary in which a crystal orientation difference between measurement points by EBSD is 3° or larger is defined as a "crystal grain" and each average IQ based on the visibility of an EBSD pattern analyzed for each crystal grain of a body centered cubic lattice (including a body centered tetragonal lattice) is used as IQ. Each average IQ described above may be merely referred to as "IQ" below. The crystal orientation difference is set to be 3° or larger to exclude lath boundaries. Note that since the body centered tetragonal lattice is elongated in one direction by the solid solution of C atoms at specific intrusive positions in the body centered cubic lattice and is equivalent in structure itself to the body centered cubic lattice, effects on low-temperature toughness are also equivalent. Further, these lattices cannot be distinguished even by EBSD. Thus, in the present invention, the measurement of the body centered cubic lattice includes that of the body centered tetragonal lattice.

The IQ is the visibility of the EBSD pattern. The IQ is known to be affected by a distortion amount in the crystal. Specifically, the smaller the IQ, the more distortions tend to exist in the crystal. The present inventors and other researchers pursued studies, paying attention to a relation of the distortion of crystal grains and low-temperature toughness. First, effects on low-temperature toughness were studied from the IQ of each measurement point by EBSD, i.e. a relationship of areas with many distortions and areas with fewer distortions, but no relationship between the IQ of each measurement point and low-temperature toughness was found. On the other hand, effects on low-temperature toughness were studied from the average IQ of each crystal grain, i.e. a relationship of the number of crystal grains with many distortions and the number of crystal grains with fewer distortions, with the result that it was found that low-temperature toughness could be improved if a control was executed to relatively increase crystal grains with fewer distortions in number with respect to the crystal grains with many distortions. It was found out that, even in a metal structure containing ferrite and retained γ, good low-temperature toughness could be obtained if the IQ distribution of each crystal grain including the body centered cubic lattice (including the body centered tetragonal lattice) of the steel sheet is properly controlled to satisfy the following Equations (1) and (2).

$$(IQave-IQmin)/(IQmax-IQmin)\geq 0.40 \quad (1)$$

$$(\sigma IQ)/(IQmax-IQmin)\leq 0.25 \quad (2)$$

wherein:

IQave denotes an average value of average IQ total data of each crystal grain,

IQmin denotes a minimum value of average IQ total data of each crystal grain,

IQmax denotes a maximum value of average IQ total data of each crystal grain, and σIQ denotes a standard deviation of the average IQ total data of each crystal grain.

The average IQ value of each crystal grain is an average value of the IQ of each crystal grain obtained from the result of EBSD measurements conducted at 180,000 points with one step of 0.25 μm by polishing a cross-section of a sample parallel to a rolling direction and setting an area of 100 μm×100 μm at a ¼ thickness position as a measurement area. Note that the crystal grains partly fragmented on a boundary line of the measurement area are excluded from measurement objects and only the crystal grains completely accommodated in the measurement area are measured.

Further, in IQ analysis, measurement points having a CI (Confidence Index)<0.1 are excluded from the analysis in terms of ensuring reliability. The CI is a degree of confidence of data and an index indicating a degree of coincidence of the EBSD pattern detected at each measurement point with a database value of a designated crystal system, e.g. a body centered cubic lattice or face centered cubic (FCC) lattice in the case of iron.

Further, in the calculation of the above Equations (1) and (2), values excluding 2% of data from the total data on each of maximum and minimum sides are used in terms of excluding abnormal values.

Further, in the above Equations (1) and (2), relativization using IQmin, IQmax is carried out in consideration of a fluctuation of absolute values of the IQs due to the influence of a detector and the like.

IQave and σIQ are indices indicating effects on low-temperature toughness and good low-temperature toughness is obtained if IQave is large and σIQ is small. In terms of ensuring good low-temperature toughness, Equation (1) is 0.40 or larger, preferably 0.42 or larger and more preferably 0.45 or larger. As the value of Equation (1) becomes larger, the crystal grains with fewer distortions increase in number and better low-temperature toughness is obtained. Thus, an upper limit is not particularly limited, but 0.80 or smaller, for example. On the other hand, Equation (2) is 0.25 or smaller, preferably 0.24 or smaller and more preferably 0.23 or smaller. As the value of Equation (2) becomes smaller, the IQ distribution of the crystal grains represented by a histogram becomes sharper and becomes a distribution preferable in improving low-temperature toughness. Thus, a lower limit is not particularly limited, but 0.15 or larger, for example.

Figure 4:
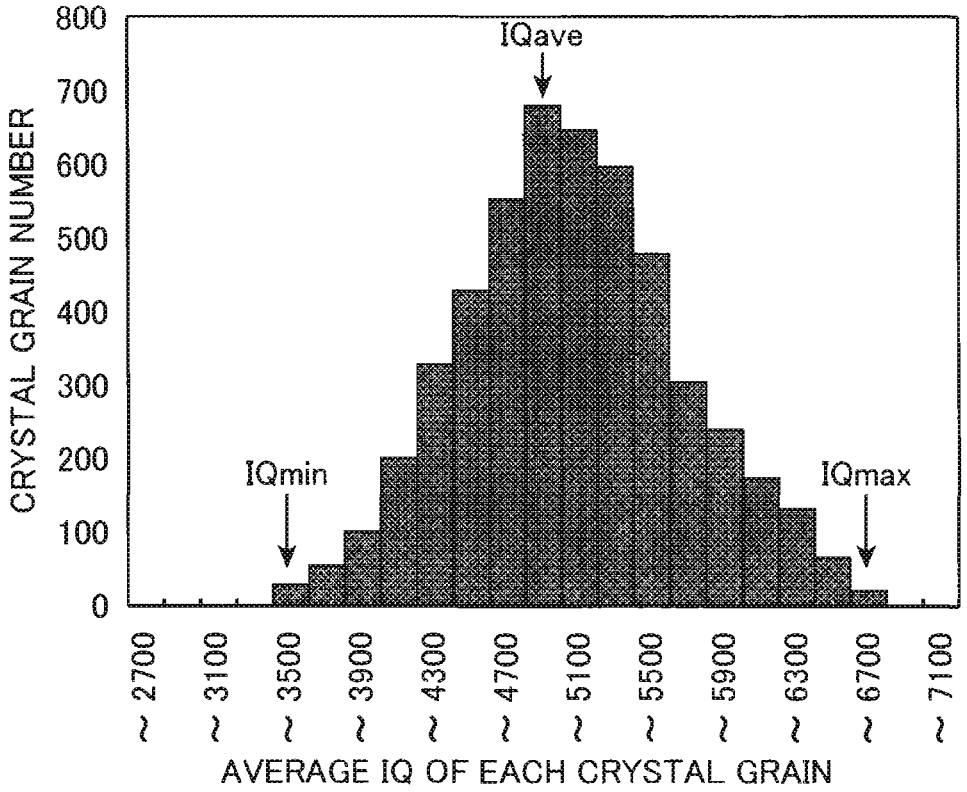
FIG. 4 is an IQ distribution chart in which Equation (1) is smaller than 0.40 and Equation (2) is 0.25 or smaller.
Figure 5:
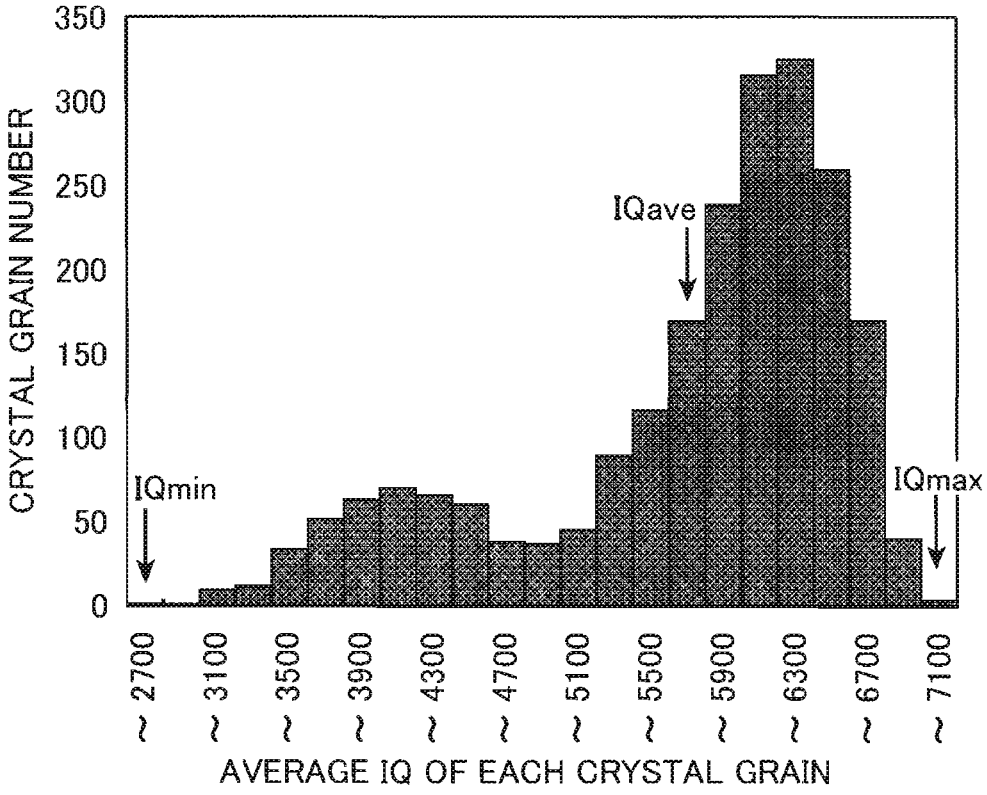
FIG. 5 is an IQ distribution chart in which Equation (I) is 0.40 or larger and Equation (2) is larger than 0.25.
Figure 6:
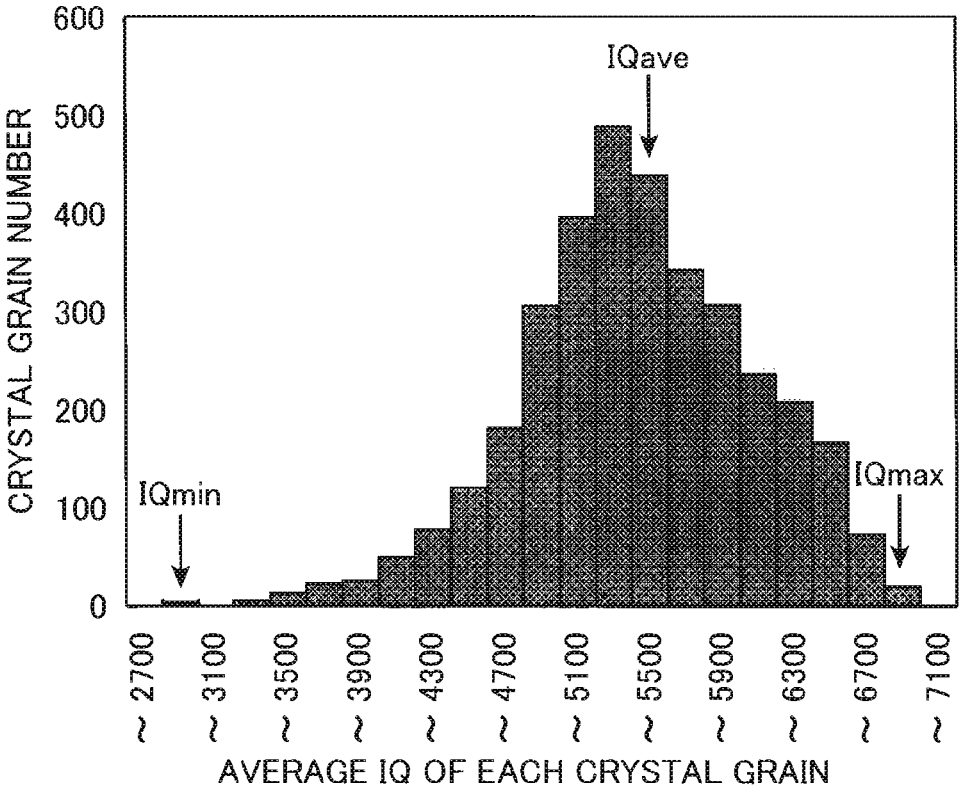
FIG. 6 is an IQ distribution chart in which Equation (1) is 0.40 or larger and Equation (2) is 0.25 or smaller.

In the present invention, excellent low-temperature toughness is obtained by satisfying both Equations (1) and (2). FIG. 4 is an IQ distribution chart in which Equation (1) is smaller than 0.40 and Equation (2) is 0.25 or smaller. FIG. 5 is an IQ distribution chart in which Equation (1) is 0.40 or larger and Equation (2) is larger than 0.25. In these charts, low-temperature toughness is poor since only either one of Equations (1) and (2) is satisfied. FIG. 6 is an IQ distribution chart in which both Equations (1) and (2) are satisfied and low-temperature toughness is good.

Qualitatively, low-temperature toughness is improved in a sharp mountain-shaped distribution with many crystal grains peaked on a crystal grain side where the average IQ is large within a range from IQmin to IQmax, i.e. at positions where the value of Equation (1) is 0.40 or larger, i.e. in an IQ distribution in which the value of Equation (2) is 0.25 or smaller as shown in FIG. 6. Why low-temperature toughness is improved is not necessarily clear, but it is thought that if Equations (1) and (2) are satisfied, the crystal grains with fewer distortions, i.e. the crystal grains with high IQ relatively increase in number with respect to the crystal grains with many distortions, i.e. the crystal grains with low IQ and the crystal grains with high distortion, which become starting points of brittle fracture, are suppressed.

Next, the metal structure characterizing the high-strength steel sheet according to the present invention is described. The metal structure of the high-strength steel sheet according to the present invention is a mixed structure containing polygonal ferrite, bainite, tempered martensite and retained γ.

[Polygonal Ferrite]

Polygonal ferrite is a structure which is softer than bainite and acts to improve processability by enhancing the elongation of the steel sheet. To exhibit such an action, an area percent of polygonal ferrite is 10% or higher, preferably 15% or higher, more preferably 20% or higher and even more preferably 25% or higher to the entire metal structure. However, since strength is reduced, if a generation amount of polygonal ferrite becomes excessive, the area percent is 50% or lower, preferably 45% or lower and more preferably 40% or lower.

An average circle-equivalent diameter D of polygonal ferrite grains is preferably not larger than 10 μm (not including 0 μm). Elongation can be further improved by reducing the average circle-equivalent diameter D of the polygonal ferrite grains and finely dispersing the polygonal ferrite grains. This detailed mechanism is not elucidated, but uneven deformation hardly occurs since polygonal ferrite is evenly dispersed in the entire metal structure by refining polygonal ferrite. This is thought to contribute to a further improvement of the elongation. Specifically, when the metal structure of the steel sheet of the present invention is composed of a mixed structure of polygonal ferrite, retained γ and remaining hard phases, the individual structure varies in size if a grain diameter of polygonal ferrite increases. This is thought to cause uneven deformation and a local concentration of distortion, thereby making it difficult to improve processability, particularly an elongation improving action by the generation of polygonal ferrite. Thus, the average circle-equivalent diameter D of polygonal ferrite is preferably 10 μm or smaller, more preferably 8 μm or smaller, even more preferably 5 μm or smaller and particularly preferably 3 μm or smaller.

The above area percent and average circle-equivalent diameter D of polygonal ferrite can be measured through observation by a scanning electron microscope (SEM).

[Bainite and Tempered Martensite]

Bainite of the present invention also includes bainitic ferrite. Bainite is a structure in which carbide is precipitated and bainitic ferrite is a structure in which carbide is not precipitated.

The steel sheet of the present invention is characterized in that bainite is composed of a composite bainite structure containing high-temperature region generated bainite and low-temperature region generated bainite and the like. By being composed of the composite bainite structure, a high-strength steel sheet with improved processability in general can be realized. Specifically, since high-temperature region generated bainite is softer than low-temperature region generated bainite and the like, it contributes to improving processability by enhancing the elongation (EL) of the steel sheet. On the other hand, since low-temperature region generated bainite and the like contain small carbide grains and retained γ grains and a stress concentration is reduced in deformation, low-temperature region generated bainite and the like contribute to an improvement of processability by enhancing the stretch flange formability (λ) and bendability (R) of the steel sheet and improving local deformability. By containing these two kinds of bainite structures, elongation can be enhanced while ensuring good local deformability, and processability in general can be enhanced. This is thought to be due to an increase of work hardening since uneven deformation is caused by compounding bainite structures having different strength levels.

The high-temperature region generated bainite is a bainite structure generated in a relatively high temperature region and, mainly, generated in a T2 temperature region of higher than 400° C. and not higher than 540° C. The high-temperature region generated bainite is a structure in which an average interval of retained γ and the like is 1 μm or longer when a nital corroded steel sheet cross-section is SEM observed.

On the other hand, the low-temperature region generated bainite is a bainite structure generated in a relatively low temperature region and, mainly, generated in a T1 temperature region of 150° C. or higher and 400° C. or lower. The low-temperature region generated bainite is a structure in which an average interval of retained γ and the like is shorter than 1 μm when the nital corroded steel sheet cross-section is SEM observed.

Here, the "average interval of retained γ and the like" is an average value of measurement results of distances between center positions of adjacent retained γ grains, distances between center positions of adjacent carbide grains or distances between center positions of adjacent retained γ grains and carbide grains when the steel sheet cross-section is SEM observed. The distance between center positions means a distance between center positions of retained γ grains and carbide grains obtained when most adjacent retained γ grains and/or carbide grains are measured. The center position is a position where a major axis and a minor axis determined for the retained γ grain or the carbide grain intersect.

Since a plurality of retained γ grains and carbide grains are connected into a needle shape or plate shape if retained γ grains and carbide grains are precipitated on a lath boundary, the distance between center positions is not a distance between retained γ grains and/or between carbide grains, but an interval between lines formed by retained γ grains and/or carbide grains connected in a major axis direction. That is, a distance between laths is the distance between center positions 2.

Further, tempered martensite is a structure having an action similar to the above low-temperature region generated bainite and contributes to an improvement of the local deformability of the steel sheet. Note that since low-temperature region generated bainite and tempered martensite described above cannot be distinguished by SEM observation, the low-temperature region generated bainite and tempered martensite are collectively called "low-temperature region generated bainite and the like" in the present invention.

In the present invention, bainite is distinguished between "high-temperature region generated bainite" and "low-temperature region generated bainite and the like" by a difference in the generation temperature region and a difference in the average interval of the retained γ and the like as described above because it is difficult to clearly distinguish bainite in general academic structure classification. For example, lath-like bainite and bainitic ferrite are classified into upper bainite and lower bainite according to a transformation temperature. However, in steel containing a large amount of Si as much as 1.0% or more as in the present invention, the precipitation of carbide accompanying bainite transformation is suppressed. Thus, it is difficult to distinguish these including the martensite structure in SEM observation. Therefore, in the present invention, bainite is not classified by academic structure definition, but distinguished based on the difference in the generation temperature region and the average interval of the retained γ and the like as described above.

A state of distribution of high-temperature region generated bainite and low-temperature region generated bainite and the like is not particularly limited. Both high-temperature region generated bainite and low-temperature region generated bainite and the like may be generated in former γ grains or high-temperature region generated bainite and low-temperature region generated bainite and the like may be separately generated in each former γ grain.

Figure 2A:
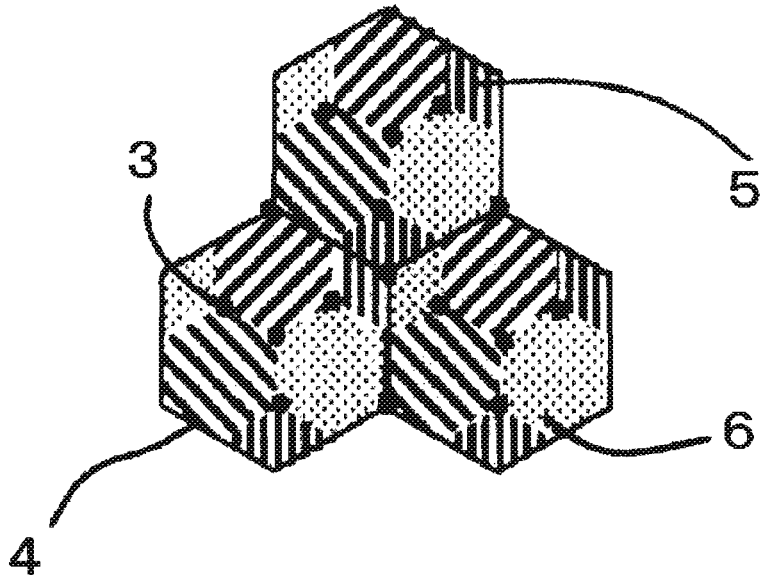
FIG. 2A is a diagram showing a state where both high-temperature region generated bainite and low-temperature region generated bainite are intermingled in former γ grains.
Figure 2B:
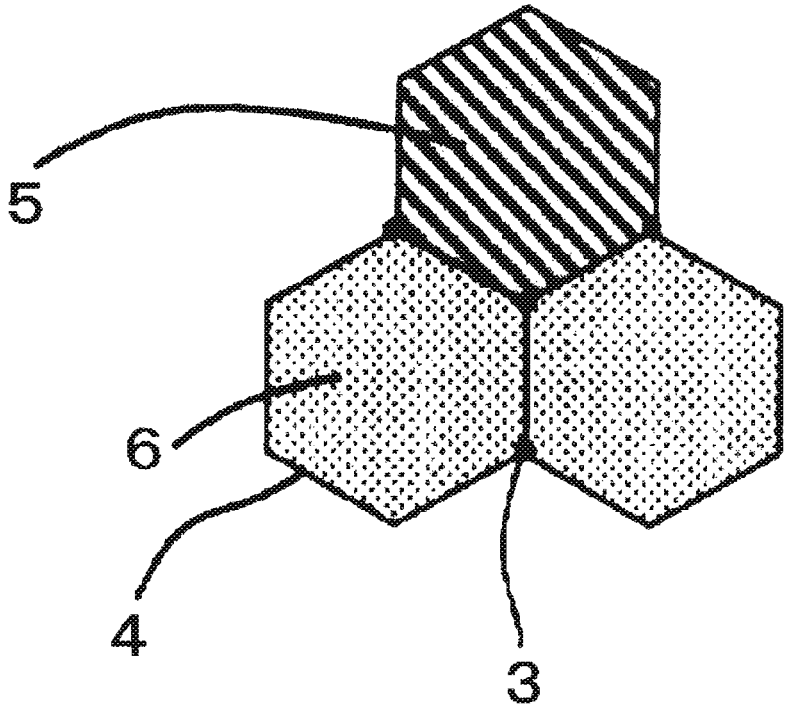
FIG. 2B is a diagram showing a state where high-temperature region generated bainite and low-temperature region generated bainite are separately generated in each former γ grain.

A state of distribution of high-temperature region generated bainite and low-temperature region generated bainite and the like is diagrammatically shown in FIGS. 2A and 2B. In FIGS. 2A and 2B, high-temperature region generated bainite is shown by oblique lines and low-temperature region generated bainite and the like are shown by fine dots. FIG. 2A shows a state where both high-temperature region generated bainite 5 and low-temperature region generated bainite and the like 6 are mixedly generated in former γ grains and FIG. 2B shows a state where high-temperature region generated bainite 5 and low-temperature region generated bainite and the like 6 are separately generated in each former γ grain. A black dot shown in each figure indicates an MA mixed phase 3. The MA mixed phase is described later.

In the present invention, when b denotes an area percent of high-temperature region generated bainite to the entire metal structure and c denotes a total area percent of low-temperature region generated bainite and the like to the entire metal structure, both the area percent b and the area percent c need to satisfy 80% or lower in terms of ensuring good ductility. Here, the total area percent of low-temperature region generated bainite and tempered martensite is specified instead of the area percent of low-temperature region generated bainite because these are structures having similar actions and these structures cannot be distinguished by SEM observation as described above.

The area percent b of high-temperature region generated bainite is set to be 80% or lower. If a generation amount of high-temperature region generated bainite is excessive, an effect brought about by compounding low-temperature region generated bainite and the like is not exhibited and particularly good ductility is not obtained. Thus, the area percent b is 80% or lower, preferably 70% or lower, more preferably 60% or lower and even more preferably 50% or lower. To improve stretch flange formability, bendability and an Erichsen value in addition to ductility, the area percent b of high-temperature region generated bainite is preferably 10% or higher, more preferably 15% or higher and even more preferably 20% or higher.

Further, the total area percent c of low-temperature region generated bainite and the like is set to be 80% or lower. If a generation amount of low-temperature region generated bainite and the like is excessive, an effect brought about by compounding high-temperature region generated bainite is not exhibited and particularly good ductility is not obtained. Thus, the area percent c is 80% or lower, preferably 70% or lower, more preferably 60% or lower and even more preferably 50% or lower. To improve stretch flange formability, bendability and the Erichsen value in addition to ductility, it is preferable to set the area percent b of high-temperature region generated bainite at 10% or higher and the total area percent c of low-temperature region generated bainite and the like at 10% or higher. If the generation amount of low-temperature region generated bainite and the like is too small, the local deformability of the steel sheet is reduced and processability cannot be improved. Thus, the total area percent c is preferably 10% or higher, more preferably 15% or higher and even more preferably 20% or higher.

A relationship of the area percent b and the total area percent c described above is not particularly limited if each range satisfies the above range and includes any of a state where b>c, a state where b<c and a state where b=c.

A mixing ratio of high-temperature region generated bainite and low-temperature region generated bainite and the like may be determined according to properties required for the steel sheet. Specifically, to further improve local deformability, particularly stretch flange formability (λ) out of the processability of the steel sheet, the ratio of high-temperature region generated bainite may be maximally reduced and the ratio of low-temperature region generated bainite and the like may be maximally increased. On the other hand, to further improve elongation out of the processability of the steel sheet, the ratio of high-temperature region generated bainite may be maximally increased and the ratio of low-temperature region generated bainite and the like may be maximally reduced. Further, to further enhance the strength of the steel sheet, the ratio of low-temperature region generated bainite and the like may be maximally increased and the ratio of high-temperature region generated bainite may be maximally reduced.

[Polygonal Ferrite+Bainite+Tempered Martensite]

In the present invention, the sum of the area percent a of polygonal ferrite, the area percent b of high-temperature region generated bainite and the total area percent c of low-temperature region generated bainite and the like (hereinafter, referred to as a "total area percent of a+b+c") preferably satisfies 70% or higher to the entire metal structure. If the total area percent of a+b+c is below 70%, elongation may be deteriorated. The total area percent of a+b+c is more preferably 75% or higher and even more preferably 80% or higher. An upper limit of the total area percent of a+b+c is determined in consideration of the space factor of retained γ measured by the saturation magnetization method and, for example, 95%.

[Retained γ]

Residual γ has an effect of prompting the hardening of deformed parts and preventing a concentration of distortion by being transformed into martensite when the steel sheet is deformed by receiving stress, whereby homogeneous deformability is improved to exhibit good elongation. Such an effect is generally called a TRIP effect.

To exhibit these effects, a volume percent of retained γ to the entire metal structure needs to be 5 volume % or higher when measured by the saturation magnetization method. Retained γ is preferably 8 volume % or higher and more preferably 10 volume % or higher. However, if a generation amount of retained γ is too much, the MA mixed phases are also excessively generated and easily coarsened. Thus, local deformability is reduced. Therefore, an upper limit of retained γ is preferably 30 volume % or lower and more preferably 25 volume % or lower.

Retained γ may be generated between laths and may be present in the form of lumps as parts of the MA mixed phases to be described later on aggregates of lath-like structures such as blocks, packets and former γ grain boundaries.

[Miscellaneous]

The metal structure of the steel sheet according to the present invention contains polygonal ferrite, bainite, tempered martensite and retained γ as described above and may be composed only of these, but (a) MA mixed phases in which quenched martensite and retained γ are compounded and (b) remaining structures such as perlite may be present without impairing the effect of the present invention.

(a) MA Mixed Phase

The MA mixed phase is generally known as a composite phase of quenched martensite and retained γ and is a structure generated by a part of a structure present as austenite left untransformed before final cooling being transformed into martensite during final cooling and the remaining part of the structure remaining as austenite. The thus generated MA mixed phase is a very hard structure since carbon is condensed into a high concentration during a heating treatment, particularly in the process of an austempering treatment held in the T2 temperature region and a part thereof is transformed into a martensite structure. Thus, a hardness difference between bainite and the MA mixed phase is large and stress concentrates and easily becomes a starting point of void generation in deformation. Thus, if the MA mixed phases are excessively generated, stretch flange formability and bendability are reduced and local deformability is reduced. Further, if the MA mixed phases are excessively generated, strength tends to become excessively high. The MA mixed phases are more easily generated as the contents of C and Si increase, but a generation amount thereof is preferably as small as possible.

The MA mixed phases are preferably 30 area % or less, more preferably 25 area % or less and even more preferably 20 area % or less to the entire metal structure when the metal structure is observed by an optical microscope.

A ratio of the number of the MA mixed phases whose circle-equivalent diameter d is larger than 7 μm to the total number of the MA mixed phases is preferably 0% or more and less than 15%. The coarse MA mixed phases whose circle-equivalent diameter d is larger than 7 μm adversely affect local deformability. The ratio of the number of the MA mixed phases whose circle-equivalent diameter d is larger than 7 μm to the total number of the MA mixed phases is more preferably less than 10% and even more preferably less than 5%.

The ratio of the number of the MA mixed phases whose circle-equivalent diameter d is larger than 7 μm may be calculated by observing a cross-sectional surface parallel to a rolling direction by the optical microscope.

Note that since it was empirically confirmed that voids tended to be more easily generated as the grain diameter of the MA mixed phases became larger, the circle-equivalent diameter d of the MA mixed phases is recommended to be as small as possible.

(b) Perlite

Perlite is preferably 20 area % or less to the entire metal structure when the metal structure is SEM observed. If an area percent of perlite exceeds 20%, elongation is deteriorated and it becomes difficult to improve processability. The area percent of perlite is more preferably 15% or less, even more preferably 10% or less and particularly preferably 5% or less to the entire metal structure.

The above metal structure can be measured in the following procedure.

[SEM Observation]

High-temperature region generated bainite, low-temperature region generated bainite and the like, polygonal ferrite and perlite can be discriminated if nital corrosion is caused at a ¼ thickness position out of a cross-section of the steel sheet parallel to the rolling direction and SEM-observed at a magnification of about 3000.

Polygonal ferrite is observed as crystal grains containing no white or light gray retained γ and the like described above inside.

High-temperature region generated bainite and low-temperature region generated bainite and the like are mainly observed in gray and as structures in which white or light gray retained γ and the like are dispersed in crystal grains. Thus, according to SEM observation, the area percent of each of high-temperature region generated bainite and low-temperature region generated bainite and the like is calculated as that also including retained γ and carbide since high-temperature region generated bainite and low-temperature region generated bainite and the like also contain retained γ and carbide.

Perlite is observed as a layered structure of carbide and ferrite.

In a nital-corroded cross-section of the steel sheet, carbide and retained γ are both observed as white or light gray structures and it is difficult to distinguish the both. Out of these, carbide such as cementite tends to be precipitated in laths rather than between laths as it is generated in a lower temperature region. Thus, it can be thought that carbide was generated in a high temperature region if intervals between carbide grains are wide and generated in a low temperature region if intervals between carbide grains are narrow. Retained γ is normally generated between laths, but the size of the laths is reduced as a generation temperature of the structure becomes lower. Thus, it can be thought that retained γ was generated in a high temperature region if intervals between retained γ grains are wide and generated in a low temperature region if intervals between retained γ grains are narrow. Therefore, in the present invention, when the nital-corroded cross-section is SEM-observed and the distances between center positions of adjacent grains of retained γ and/or carbide are measured, paying attention to retained γ and carbide observed in white or light gray in an observation view field, the structure having an average value (average interval) of 1 μm or longer is considered as high-temperature region generated bainite and the structure having an average interval of shorter than 1 μm is considered as low-temperature region generated bainite and the like.

[Saturation Magnetization Method]

Since the structure of retained γ cannot be identified by SEM observation, the volume percent is measured by the saturation magnetization method. The volume percent of retained γ obtained in this way can be directly read as an area percent. For a detailed measurement principle by the saturation magnetization method, reference may be made to "R&D Kobe Steel Technical Report, Vol. 52, No. 3, 2002, pp. 43 to 46".

As just described, in the present invention, the volume percent of retained γ is measured by the saturation magnetization method, whereas the area percent of each of high-temperature region generated bainite and low-temperature region generated bainite and the like is measured, including retained γ, by SEM observation. Thus, the sum of these may exceed 100%.

[Optical Microscope Observation]

The MA mixed phase is observed as a white structure when Repera corrosion is caused at a ¼ thickness position out of a cross-section of the steel sheet parallel to the rolling direction and observed at a magnification of about 1000 by an optical microscope.

Next, a chemical component composition of the high-strength steel sheet according to the present invention is described.

<<Component Composition>>

The high-strength steel sheet of the present invention is a steel sheet satisfying, in mass %, C: 0.10 to 0.5%, Si: 1.0 to 3.0%, Mn: 1.5 to 3%, Al: 0.005 to 1.0%, P: more than 0% and not more than 0.1% and S: more than 0% and not more than 0.05% with the balance being iron and inevitable impurities. These ranges are determined for the following reason.

[C: 0.10 to 0.5%]

C is an element necessary to enhance the strength of the steel sheet and generate retained γ. Accordingly, the amount of C is not less than 0.10%, preferably not less than 0.13% and more preferably not less than 0.15%. However, if C is excessively contained, weldability is reduced. Thus, the amount of C is not more than 0.5%, preferably not more than 0.3%, more preferably not more than 0.25% and even more preferably not more than 0.20%.

[Si: 0.10 to 3.0%]

Si is an element very important in effectively generating retained γ by suppressing the precipitation of carbide during holding in the T1 temperature region and the T2 temperature region to be described later, i.e. during the austempering treatment in addition to contributing to increasing the strength of the steel sheet as a solid solution strengthening element. Accordingly, the amount of Si is not less than 1.0%, preferably not less than 1.2% and more preferably not less than 1.3%. However, if Si is excessively contained, reverse transformation into a γ phase does not occur during heating and soaking in annealing and a large amount of polygonal ferrite remains, leading to a shortage of strength. Further, Si scales are generated on a steel sheet surface in hot rolling to deteriorate a surface property of the steel sheet. Thus, the amount of Si is not more than 3.0%, preferably not more than 2.5% and more preferably not more than 2.0%.

[Mn: 1.5 to 3.0%]

Mn is an element necessary to obtain bainite and tempered martensite. Further, Mn is an element which effectively acts to generate retained γ by stabilizing austenite. To exhibit these actions, the amount of Mn is not less than 1.5%, preferably not less than 1.8% and more preferably not less than 2.0%. However, if Mn is excessively contained, the generation of high-temperature region generated bainite is drastically suppressed. Further, excessive addition of Mn leads to the deterioration of weldability and the deterioration of processability due to segregation. Thus, the amount of Mn is not more than 3%, preferably not more than 2.8% and more preferably not more than 2.7%.

[Al: 0.005 to 1.0%]

Al is, similarly to Si, an element which contributes to the generation of retained γ by suppressing the precipitation of carbide during the austempering treatment. Further, Al is an element which acts as deoxidizer in a steel production process. Thus, the amount of Al is not less than 0.005%, preferably not less than 0.01% and more preferably not less than 0.03%. However, if Al is excessively contained, inclusion in the steel sheet becomes excessive to deteriorate ductility. Thus, the amount of Al is not more than 1.0%, preferably not more than 0.8% and more preferably not more than 0.5%.

[P: More than 0% and not More than 0.1%]

P is an impurity element unavoidably contained in steel. If the amount of P is excessive, the weldability of the steel sheet is deteriorated. Thus, the amount of P is not more than 0.1%, preferably not more than 0.08% and more preferably not more than 0.05%. Although the amount of P is preferably as small as possible, it is industrially difficult to set the amount of P at 0%.

[S: More than 0% and not More than 0.05%]

S is an impurity element unavoidably contained in steel and, similarly to P described above, an element which deteriorates the weldability of the steel sheet. Further, S forms sulfide-based inclusion in the steel sheet and processability is reduced if this sulfide-based inclusion increases. Thus, the amount of S is not more than 0.05%, preferably not more than 0.01% and more preferably not more than 0.005%. Although the amount of S is preferably as small as possible, it is industrially difficult to set the amount of S at 0%.

The high-strength steel sheet according to the present invention satisfies the above component composition and the balance components are iron and inevitable impurities other than P, S described above. Inevitable impurities include, for example, N, O (oxygen) and tramp elements (e.g. Pb, Bi, Sb and Sn). Out of inevitable impurities, the amount of N is preferably more than 0% and not more than 0.01% and the amount of O is preferably more than 0% and not more than 0.01%.

[N: More than 0% and not More than 0.01%]

N is an element which contributes to the strengthening of the steel sheet by causing nitride to precipitate in the steel sheet. If N is excessively contained, a large amount of nitride precipitates to deteriorate elongation, stretch flange formability and bendability. Thus, the amount of N is preferably not more than 0.01%, more preferably not more than 0.008% and even more preferably not more than 0.005%.

[O: More than 0% and not More than 0.01%]

O (oxygen) is an element which causes a reduction in elongation, stretch flange formability and bendability when being excessively contained. Thus, the amount of O is preferably not more than 0.01%, more preferably not more than 0.005% and even more preferably not more than 0.003%.

The steel sheet of the present invention may further contain as other elements:

(a) One or more elements selected from a group consisting of Cr: more than 0% and not more than 1% and Mo: more than 0% and not more than 1%, (b) One or more elements selected from a group consisting of Ti: more than 0% and not more than 0.15%, Nb: more than 0% and not more than 0.15% and V: more than 0% and not more than 0.15%, (c) One or more elements selected from a group consisting of Cu: more than 0% and not more than 1% and Ni: more than 0% and not more than 1%, (d) B: more than 0% and not more than 0.005%, and (e) One or more elements selected from a group consisting of Ca: more than 0% and not more than 0.01%, Mg: more than 0% and not more than 0.01% and rare-earth elements: more than 0% and not more than 0.01%.

(a) [One or More Elements Selected from Group Consisting of Cr: More than 0% and not More than 1% and Mo: More than 0% and not More than 1%]

Cr and Mo are elements which effectively act to obtain bainite and tempered martensite similarly to Mn described above. These elements can be used singly or in combination. To effectively exhibit this action, the single content of each of Cr and Mo is preferably not less than 0.1% and more preferably not less than 0.2%. However, if the content of each of Cr and Mo exceeds 1%, the generation of high-temperature region generated bainite is drastically suppressed and the amount of retained γ decreases. Further, excessive addition leads to a cost increase. Thus, the content of each of Cr and Mo is preferably not more than 1%, more preferably not more than 0.8% and even more preferably not more than 0.5%. In the case of using Cr and Mo in combination, a total amount is recommended to be not more than 1.5%.

(b) [One or More Elements Selected from Group Consisting of Ti; More than 0% and not More than 0.15%, Nb: More than 0% and not More than 0.15% and V: More than 0% and not More than 0.15%]

Ti, Nb and V are elements which act to strengthen the steel sheet by forming precipitates such as carbide and nitride in the steel sheet and refine polygonal ferrite grains by refining former γ grains. To effectively exhibit these actions, the single content of each of Ti, Nb and V is preferably not less than 0.01% and more preferably not less than 0.02%. However, excessive content leads to the precipitation of carbide in grain boundaries and the deterioration of the stretch flange formability and bendability of the steel sheet. Thus, the single content of each of Ti, Nb and V is preferably not more than 0.15%, more preferably not more than 0.12% and even more preferably not more than 0.1%. Each of Ti, Nb and V may be singly contained or two or more elements arbitrarily selected may be contained.

(c) [One or More Elements Selected from Group Consisting of Cu; More than 0% and not More than 1% and Ni: More than 0% and not More than 1%]

Cu and Ni are elements which effectively act to generate retained γ by stabilizing γ. These elements can be used singly or in combination. To effectively exhibit this action, the single content of each of Cu and Ni is preferably not less than 0.05% and more preferably not less than 0.1%. However, if Cu and Ni are excessively contained, hot processability is deteriorated. Thus, the single content of each of Cu and Ni is preferably not more than 1%, more preferably not more than 0.8% and even more preferably not more than 0.5%. Note that hot processability is deteriorated if the content of Cu exceeds 1%, but the deterioration of hot processability is suppressed if Ni is added. Thus, more than 1% of Cu may be added, although it leads to a cost increase, in the case of using Cu and Ni in combination.

(d) [B: More than 0% and not More than 0.005%]

B is an element which effectively acts to generate bainite and tempered martensite, similarly to Mn, Cr and Mo described above. To effectively exhibit this action, the content of B is preferably not less than 0.0005% and more preferably not less than 0.001%. However, if B is excessively contained, boride is generated in the steel sheet to deteriorate ductility. Further, if B is excessively contained, the generation of high-temperature region generated bainite is drastically suppressed, similarly to Cr and Mo described above. Thus, the content of B is preferably not more than 0.005%, more preferably not more than 0.004% and even more preferably not more than 0.003%.

(e) [One or More Elements Selected from Group Consisting of Ca; More than 0% and not More than 0.01%, Mg: More than 0% and not More than 0.01% and Rare-Earth Elements: More than 0% and not More than 0.01%]

Ca, Mg and rare-earth elements (REM) are elements which act to finely disperse inclusion in the steel sheet. To effectively exhibit this action, the single content of each of Ca, Mg and rare-earth elements is preferably not less than 0.0005% and more preferably not less than 0.001%. However, excessive content leads to difficulty to produce by deteriorating castability, hot processability and the like. Further, excessive addition causes the deterioration of the ductility of the steel sheet. Thus, the single content of each of Ca, Mg and rare-earth elements is preferably not more than 0.01%, more preferably 0.005% and even more preferably not more than 0.003%.

The rare-earth elements mean to include lanthanoid elements (15 elements from La to Lu) and Sc (scandium) and Y (yttrium). Out of these elements, it is preferable to contain at least one element selected from a group consisting of La, Ce and Y and more preferable to contain La and/Ce.

<<Producing Method>>

Next, a producing method of the above high-strength steel sheet is described. The above high-strength steel sheet can be produced by successively performing a step of heating a steel sheet satisfying the above component composition to a two-phase temperature region of 800° C. or higher and an $Ac_3$ point—10° C. or lower, a step of holding and soaking the steel sheet in this temperature region for 50 seconds or longer, a step of cooling the steel sheet at an average cooling rate of 10° C. or higher up to an arbitrary temperature T satisfying 150° C. or higher and 400° C. or lower (an Ms point or lower when the Ms point is 400° C. or lower), a step of holding the steel sheet in the T1 temperature region satisfying the following Equation (3) for 10 to 200 seconds and a step of holding the steel sheet in the T2 temperature region satisfying the following Equation (4) for 50 seconds or longer.

$$150^\circ\ C. \leq T1(^\circ\ C.) \leq 400^\circ\ C. \quad (3)$$

$$400^\circ\ C. < T2(^\circ\ C.) \leq 540^\circ\ C. \quad (4)$$

Particularly, in the present invention, a proper IQ distribution specified in the present invention, for example, as shown in FIG. 6 can be obtained by properly controlling production conditions such as the heating temperature, the cooling temperature, the holding times and the cooling rate in the production method for obtaining the high-strength steel sheet by cooling and holding the steel sheet in the T1 temperature region after soaking the steel sheet in the two-phase region and, then, reheating the steel sheet up to the T2 temperature region and holding it in this temperature region. Note that the IQ distribution tends to be the one, for example, as shown in FIG. 5 and sufficient low-temperature toughness is not obtained by a conventionally known TRIP steel sheet production method such as a general TRIP steel sheet production method for cooling a steel sheet to a bainite transformation temperature region and holding the steel sheet in that temperature region after soaking the steel sheet in a two-phase region as also shown in Examples described later.

[Hot Rolling and Cold Rolling]

First, a slab is hot rolled in accordance with a conventional method and the obtained hot rolled steel sheet is cold rolled to prepare a cold rolled steel sheet. In hot rolling, a finish rolling temperature may be, for example, set at 800° C. or higher and a winding temperature may be, for example, set at 700° C. or lower. In cold rolling, rolling may be performed with a cold rolling rate set, for example, in a range of 10 to 70%.

[Soaking]

The cold rolled steel sheet obtained in this way is subjected to the soaking step. Specifically, the steel sheet is heated to the temperature region of 800° C. or higher and the $Ac_3$ point—10° C. or lower and soaked by being held in this temperature region for 50 seconds longer in a continuous annealing line.

By controlling a heating temperature to a two-phase temperature region of ferrite and austenite, a predetermined amount of polygonal ferrite can be generated. If the heating temperature is too high, it leads to an austenite single phase region and the generation of polygonal ferrite is suppressed. Thus, the elongation of the steel sheet cannot be improved and processability is deteriorated. Accordingly, the heating temperature is the $Ac_3$ point—10° C. or lower, preferably the $Ac_3$ point—15° C. or lower and more preferably the $Ac_3$ point—20° C. or lower. On the other hand, if the heating temperature falls below 800° C., the amount of polygonal ferrite becomes excessive and strength is reduced. Further, a wrought structure due to cold rolling remains and elongation is also reduced. Therefore, the heating temperature is 800° or higher, preferably 810° C. or higher and more preferably 820° or higher.

A soaking time in the above temperature region is 50 seconds or longer. If the soaking time is shorter than 50 seconds, the steel sheet cannot be uniformly heated. Thus, carbide remains in a solid solution state, the generation of retained γ is suppressed and ductility is reduced. Accordingly, the soaking time is set to be 50 seconds or longer, preferably 100 seconds or longer. However, if the soaking time is too long, austenite grain diameters become large and, associated with that, polygonal ferrite grains are also coarsened, whereby elongation and local deformability tend to become poor. Therefore, the soaking time is preferably 500 seconds or shorter and more preferably 450 seconds or shorter.

Note that an average heating rate when the above cold rolled steel sheet is heated to the two-phase temperature region may be set, for example, at 1° C./s or higher.

In the present invention, the $Ac_3$ point can be calculated from the following Equation (a) described in "The Physical Metallurgy of Steels" by Leslie (issued on May 31, 1985 by Maruzen Co., Ltd., P. 273). In the following Equation (a), [ ] indicates a content (mass %) of each element and the content of the element not contained in the steel sheet may be calculated as 0 mass %.

$$Ac_3(°\ C.)=910-203\times[C]^{1/2}+44.7\times[Si]-30\times[Mn]-11\times[Cr]+31.5\times[Mo]-20\times[Cu]-15.2\times[Ni]+400\times[Ti]+104\times[V]+700\times[P]+400\times[Al] \quad (a)$$

[Cooling Step]

After the steel sheet is heated to the two-phase temperature region and soaked while being held for 50 seconds or longer, it is quickly cooled at an average cooling rate of 10° C./s or higher up to the arbitrary temperature T satisfying 150° C. or higher and 400° C. or lower (Ms point or lower if the Ms point is 400° C. or lower). The above T is called a "rapid cooling stop temperature T" in some cases below. By quickly cooling the steel sheet in a range from the two-phase temperature range to the rapid cooling stop temperature T after soaking, it is possible to generate martensite effective in promoting the generation of low-temperature region generated bainite and high-temperature region generated bainite while ensuring a predetermined amount of polygonal ferrite.

[Rapid Cooling Stop Temperature]

If the rapid cooling stop temperature T falls below 150° C., a generation amount of martensite increases, the amount of retained γ becomes insufficient and elongation is deteriorated. The rapid cooling stop temperature T is 150° or higher, preferably 160° C. or higher and more preferably 170° C. or higher. On the other hand, if the rapid cooling stop temperature T exceeds 400° C. (exceeds the Ms point if the Ms point is lower than 400° C.), a desired IQ distribution is not obtained and low-temperature toughness is deteriorated. Thus, the rapid cooling stop temperature T is 400° or lower (Ms point or lower if the Ms point is lower than 400° C.), preferably 380° C. or lower (Ms point—20° C. or lower if the Ms point is lower than 380° C.) and more preferably 350° C. or lower (Ms point—50° C. or lower if the Ms point—50° C. is lower than 350° C.).

Note that, in the present invention, the Ms point can be calculated from the following Equation (b) obtained considering a ferrite fraction (Vf) from an equation described in "The Physical Metallurgy of Steels" by Leslie (P. 231). In Equation (b), [ ] indicates a content (mass %) of each element and the content of the element not contained in the steel sheet may be calculated as 0 mass %.

$$\text{Ms point}(°\ C.)=561-474\times[C]/(1-Vf/100)-33\times[Mn]-17\times[Ni]-17\times[Cr]-21\times[Mo] \quad (b)$$

Here, Vf denotes a ferrite fraction (area %). Since it is difficult to directly measure the ferrite fraction during production, Vf is a ferrite fraction measurement value in a sample replicating an annealing pattern from heating, soaking to cooling when the sample is separately fabricated.

If the average cooling rate from the two-phase temperature region to the rapid cooling stop temperature T falls below 10° C./s, ferrite is excessively generated and perlite transformation occurs to excessively generate perlite, whereby the amount of retained γ becomes insufficient and elongation is reduced. The average cooling rate in the above temperature region is 10° C./s or higher, preferably 15° C./s or higher and more preferably 20° C./s or higher. An upper limit of the average cooling rate of the above temperature region is not particularly limited. However, since a temperature control is difficult if the average cooling rate is excessively increased, the upper limit may be, for example, about 100° C./s.

[Holding in T1 Temperature Region]

By holding the steel sheet in the T1 temperature region of 150° C. or higher and 400° C. or lower specified by the above Equation (3) for a predetermined time after cooling the steel sheet up to the rapid cooling stop temperature T, a desired IQ distribution satisfying the above Equations (1) and (2) is attained and good low-temperature toughness can be ensured. However, if the holding temperature is higher than 400° C., the above Equations (1) and (2) are not satisfied and the IQ distribution becomes, for example, the distribution shown in FIG. 4 or 5 and sufficient low-temperature toughness is not obtained. Thus, the T1 temperature region is 400° C. or lower, preferably 380° C. or lower and more preferably 350° C. or lower. On the other hand, if the holding temperature falls below 150° C., a martensite fraction becomes excessively large, the amount of retained γ decreases and elongation is reduced. Thus, a lower limit of the T1 temperature region is 150° C. or higher, preferably 160° C. or higher and more preferably 170° C. or higher.

The holding time in the T1 temperature region satisfying the above Equation (3) is set at 10 to 200 seconds. If the holding time in the T1 temperature region is too short, a desired IQ distribution is not obtained, an IQ distribution, for example, as shown in FIG. 4 or 5 is attained and low-temperature toughness is deteriorated. Thus, the holding time in the T1 temperature region is 10 seconds or longer, preferably 15 seconds or longer, more preferably 30 seconds or longer and even more preferably 50 seconds or longer. However, if the holding time exceeds 200 seconds, a desired amount of retained γ cannot be ensured even if the steel sheet is held in the T2 temperature region for a predetermined time, and EL is reduced since low-temperature region generated bainite is excessively generated. Thus, the holding time in the T1 temperature region is 200 seconds or shorter, preferably 180 seconds or shorter and more preferably 150 seconds or shorter.

In the present invention, the holding time in the T1 temperature region means a time until the temperature of the steel sheet reaches 400° C. by starting heating after the steel sheet is held in the T1 temperature region after the temperature of the steel sheet reaches 400° C. (Ms point if the Ms point is 400° C. or lower) by cooling the steel sheet after soaking it at the predetermined temperature. For example, the holding time in the T1 temperature region is a time of a section "x" in FIG. 3. Since the steel sheet is cooled to a room temperature after being held in the T2 temperature region as described later in the present invention, the steel sheet passes through the T1 temperature region again. However, in the present invention, this passage time during cooling is not included in the residence time in the T1 temperature region. This is because transformation is almost completed during this cooling.

The method for holding the steel sheet in the T1 temperature region satisfying the above Equation (3) is not particularly limited if the holding time in the T1 temperature region is 10 to 200 seconds. For example, heat patterns shown in (i) to (iii) of FIG. 3 may be adopted. However, the present invention is not limited to this and heat patterns other than the above can be appropriately adopted as long as requirements of the present invention are satisfied.

Figure 3:
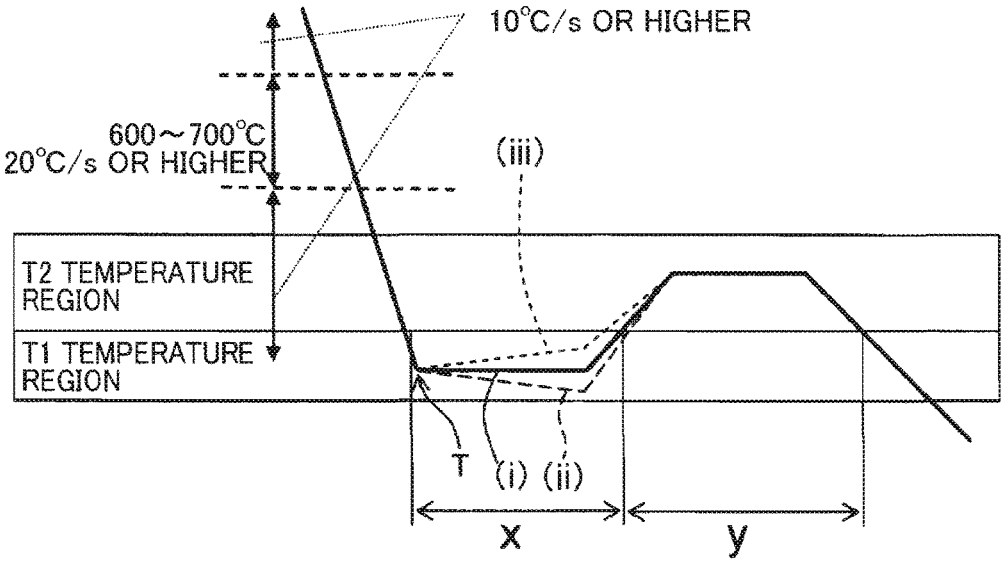
FIG. 3 is a diagram showing examples of heat patterns in a T1 temperature region and a T2 temperature region.

Out of these, (i) of FIG. 3 is an example in which the steel sheet is held at the constant rapid cooling stop temperature T for a predetermined time after being quickly cooled from the soaking temperature to the arbitrary rapid cooling stop temperature T, and the steel sheet is heated up to an arbitrary temperature satisfying the above Equation (4) after being held at the constant temperature. Although the steel sheet is held at the constant temperature in one stage in (i) of FIG. 3, the present invention is not limited to this and the steel sheet may be held at different constant temperatures in two or more stages if within the T1 temperature region although not shown.

(ii) of FIG. 3 is an example in which the cooling rate is changed after the steel sheet is quickly cooled from the soaking temperature to the arbitrary rapid cooling stop temperature T and, then, the steel sheet is heated up to an arbitrary temperature satisfying the above Equation (4) after being cooled within the T1 temperature region for a predetermined time. Although the steel sheet is cooled in one stage in (ii) of FIG. 3, the present invention is not limited to this and the steel sheet may be cooled in two or more stages with different cooling rates (not shown).

(iii) of FIG. 3 is an example in which the steel sheet is heated within the T1 temperature region for a predetermined time after being quickly cooled from the soaking temperature to the arbitrary rapid cooling stop temperature T and, then, heated up to an arbitrary temperature satisfying the above Equation (4). Although the steel sheet is heated in one stage in (iii) of FIG. 3, the present invention is not limited to this and the steel sheet may be heated in two or more stages with different temperature increasing rates although not shown.

[Holding in T2 Temperature Region]

By holing the steel sheet in the T2 temperature region of higher than 400° C. and not higher than 540° C. specified by the above Equation (4), a desired IQ distribution satisfying the above Equations (1) and (2) can be obtained while ensuring retained γ. Specifically, if the steel sheet is held in a temperature region exceeding 540° C., soft polygonal ferrite and pseudo perlite are generated, a desired amount of retained γ cannot be obtained and elongation cannot be ensured. Thus, an upper limit of the T2 temperature region is 540° C. or lower, preferably 500° C. or lower and more preferably 480° C. or lower. On the other hand, at 400° C. or lower, the amount of high-temperature region generated bainite is reduced and accompanying carbon condensation into untransformed parts becomes insufficient to reduce the amount of retained γ. Thus, elongation is reduced. Therefore, a lower limit of the T2 temperature region is higher than 400° C., preferably 420° C. or higher and more preferably 425° C. or higher.

The holding time in the T2 temperature region satisfying the above Equation (4) is 50 seconds or longer. If the holding time is shorter than 50 seconds, the desired IQ distribution is not obtained, an IQ distribution, for example, as shown in FIG. 3 is attained and low-temperature toughness is deteriorated. Further, since a large amount of untransformed austenite remains and carbon condensation is insufficient, hard quenched martensite is generated during final cooling from the T2 temperature region. Thus, many coarse MA mixed phases are generated and strength is excessively increased to reduce elongation. In terms of improving productivity, the holding time in the T2 temperature region is as short as possible. However, to sufficiently promote carbon condensation, the holding time is preferably set at 90 seconds or longer and more preferably set at 120 seconds or longer. An upper limit of the holding time in the T2 temperature region is not particularly limited, but obtained effects are saturated and productivity is reduced even if the steel sheet is held in this temperature region for a long time. Further, condensed carbon precipitates as carbide, retained γ cannot be ensured and elongation is deteriorated. Thus, the holding time in the T2 temperature region is preferably 1800 seconds or shorter, more preferably 1500 seconds or shorter, even more preferably 1000 seconds or shorter, further more preferably 500 seconds or shorter and further even more preferably 300 seconds or shorter.

Here, the holding time in the T2 temperature region means a time until the temperature of the steel sheet reaches 400° C. by starting cooling after the steel sheet is held in the T2 temperature region after the temperature of the steel sheet reaches 400° C. by heating the steel sheet after holding it in the T1 temperature region. For example, the holding time in the T2 temperature region is a time of a section "y" in FIG. 3. In the present invention, as described above, the steel sheet passes through the T2 temperature region while being cooled to the T1 temperature region after soaking. However, in the present invention, this passage time during cooling is not included in the residence time in the T2 temperature region. This is because transformation hardly occurs during this cooling since the residence time is too short.

The method for holding the steel sheet in the T2 temperature region satisfying the above Equation (4) is not particularly limited if the holding time in the T2 temperature region is 50 seconds or longer. The steel sheet may be held at an arbitrary constant temperature in the T2 temperature region as in the heat patterns in the above T1 temperature region or may be cooled or heated in the T2 temperature region.

Note that the steel sheet is held in the T2 temperature region on a high temperature side after being held in the T1 temperature region on a low temperature side in the present invention. However, the present inventors and other researchers have confirmed that, although low-temperature region generated bainite and the like generated in the T1 temperature region are heated to the T2 temperature region and a lower structure is recovered by tempering, lath intervals, i.e. average intervals of retained γ and/or carbide do not change.

[Plating]

An electro-galvanized (EG) layer, a hot dip galvanized (GI) layer or an alloyed hot dip galvanized (GA) layer may be formed on the surface of the high-strength steel sheet.

Formation conditions of the electro-galvanized layer, the hot dip galvanized layer or the alloyed hot dip galvanized layer are not particularly limited, and a conventional electro-galvanizing treatment, hot dip galvanizing treatment or alloying treatment can be adopted. In this way, an electro-galvanized steel sheet (hereinafter, referred to as an "EG steel sheet" in some cases), a hot dip galvanized steel sheet (hereinafter, referred to as a "GI steel sheet" in some cases) and an alloyed hot dip galvanized steel sheet (hereinafter, referred to as a "GA steel sheet" in some cases) are obtained.

In the case of producing an EG steel sheet, a method is, for example, adopted in which the electro-galvanizing treatment is applied by applying a current while immersing the above steel sheet in a zinc solution of 55° C.

In the case of producing a GI steel sheet, a method is, for example, adopted in which hot dip galvanizing is applied by immersing the above steel sheet in a plating bath whose temperature is adjusted to about 430 to 500° C. and, thereafter, the steel sheet is cooled.

In the case of producing a GA steel sheet, a method is, for example, adopted in which the above steel sheet is heated to a temperature of about 500 to 540° to be alloyed after the above hot dip galvanizing, and is cooled.

Further, in the case of producing a GI steel sheet, a step of holding the steel sheet in the T2 temperature region after holding the steel sheet in the T1 temperature region and the hot dip galvanizing treatment may be simultaneously performed. Specifically, hot dip galvanizing is applied by immersing the steel sheet in the plating bath adjusted to the aforementioned temperature region in the T2 temperature region after holding the steel sheet in the T1 temperature region, whereby hot dip galvanizing and holding in the T2 temperature region may be simultaneously performed. Further, in the case of producing a GA steel sheet, the alloying treatment may be applied following hot dip galvanizing in the above T2 temperature region.

The coating weight of electro-galvanizing is also not particularly limited and may be, for example, about 10 to 100 g/m$^2$ per surface.

[Fields of Application of High-Strength Steel Sheet of Present Invention]

The technology of the present invention can be suitably adopted for thin steel sheets having a sheet thickness of 3 mm or smaller. Since the high-strength steel sheet of the present invention has a tensile strength of 780 MPa or more and is good in ductility, preferably in processability. Further, low-temperature toughness is also good and brittle fracture, for example, under a low temperature environment of −20° C. or lower can be suppressed. This steel sheet is suitably used as a material of structural components of automotive vehicles. Examples of structural components of automotive vehicles are reinforcing members such as pillars (e.g. bears, center pillar reinforces), reinforcing members for roof rails, vehicle body constituent components such as side sills, floor members and kick portions, impact resistant absorbing components such as reinforcing members for bumpers and door impact beams and seat components, including collision components such as front and rear side members and crash boxes. Further, since hot processability is also good according to the preferred configuration of the present invention, the steel sheet can be suitably used as a material for hot molding. Note that hot molding means molding in a temperature range of about 50 to 500° C.

This application claims the benefit of the priority based on Japanese Patent Application No. 2013-202536 filed with the Japan Patent Office on Sep. 27, 2013 and Japanese Patent Application No. 2014-071907 filed with the Japan Patent Office on Mar. 31, 2014. The entire contents of the specifications of Japanese Patent Application No. 2013-202536 filed on Sep. 27, 2013 and Japanese Patent Application No. 2014-071907 filed on Mar. 31, 2014 are incorporated herein for reference.

Examples

The present invention is specifically described by way of examples below. However, the present invention is not limited by the following examples and can be, of course, carried out while being suitably changed within the range conformable to the gist described above and below. Any of those is encompassed in the technical scope of the present invention.

Steels having chemical component compositions shown in Table 1 below with the balance Iron and inevitable impurities other than P, S, N and O were vacuum-smelted to produce slabs for experiment. In Table 1 below, misch metal containing about 50% of La and about 30% of Ce was used as REM.

The $Ac_3$ point was calculated based on the chemical components shown in Table 1 below and the above Equation (a) and the Ms point was calculated based on the chemical components and the above Equation (b).

The obtained slab for experiment was cold rolled after being hot rolled and, subsequently, continuously annealed to produce a sample. Specific conditions are as follows.

After the slab for experiment was heated and held at 1250° C. for 30 minutes, a pressure reduction ratio was set at about 90%, hot rolling was so performed that a finish rolling temperature became 920° C. and the slab was cooled up to a winding temperature of 500° C. at an average cooling rate of 30° C./s from the finish rolling temperature and wound. After winding, the slab was held at the winding temperature of 500° C. for 30 minutes and, subsequently, furnace-cooled up to a room temperature to produce a hot rolled steel sheet having a sheet thickness of 2.6 mm.

After the obtained hot rolled steel sheet was washed with acid and surface scales were removed, cold rolling was performed at a cold rolling rate of 46% to produce a cold rolled steel sheet having a sheet thickness of 1.4 mm.

The obtained cold rolled steel sheet was continuously annealed in accordance with a pattern i to iii shown in Tables 2 and 3 below to produce a sample after being heated to a "Soaking Temperature (° C.)" shown in Tables 2 and 3 and held and soaked for a "soaking time (s)" shown in Tables 2 and 3. Note that a pattern such as step cooling different from the patterns i to iii was applied for some cold rolled steel sheets. For these, "-" is written in a column of "Pattern" in Tables 2 and 3.

(Pattern i: Corresponding to (i) of FIG. 3)

After soaking, the steel sheet was quickly cooled at an "average cooling rate (° C./s)" shown in Tables 2 and 3, then held at this constant rapid cooling stop temperature T for a holding time (s) in the T1 temperature region shown in Tables 2 and 3, subsequently healed up to a "holding temperature (° C.)" in the T2 temperature region shown in Tables 2 and 3 and held at this constant temperature for a "holding time at holding temperature (s)" shown in Tables 2 and 3.

(Pattern ii: Corresponding to (ii) of FIG. 3)

After soaking, the steel sheet was cooled up to the "rapid cooling stop temperature T (° C.)" shown in Tables 2 and 3 at the "average cooling rate (° C./s)" shown in Tables 2 and 3, then cooled from this rapid cooling stop temperature T to an "end temperature (° C.)" shown in Tables 2 and 3 for a "holding time (s)" in the T1 temperature region shown in Tables 2 and 3, subsequently heated up to the "holding temperature (° C.)" in the T2 temperature region shown in Tables 2 and 3 and held at this constant temperature for the "holding time (s)" shown in Tables 2 and 3.

(Pattern iii: Corresponding to (iii) of FIG. 3)

After soaking, the steel sheet was cooled up to the "rapid cooling stop temperature T (° C.)" shown in Tables 2 and 3 at the "average cooling rate (° C./s)" shown in Tables 2 and 3, then heated from this rapid cooling stop temperature T to the "end temperature (° C.)" shown in Tables 2 and 3 for the "holding time (s)" in the T1 temperature shown in Tables 2 and 3, subsequently heated up to the "holding time (° C.)" in the T2 temperature region shown in Tables 2 and 3 and held at this constant temperature for the "holding time (s)" shown in Tables 2 and 3.

In Tables 2 and 3, a time (s) until the holding temperature in the T2 temperature region was reached after the holding in the T1 temperature region was completed is also shown as "a time (s) of T1→T2". Further, the "holding time (s) in T1 temperature region" corresponding to the residence time in the section "x" in FIG. 3 and the "holding time (s) in T2 temperature region" corresponding to the residence time in the section "y" in FIG. 3 are respectively shown in Tables 2 and 3. After being held in the T2 temperature region, the steel sheet was cooled up to the room temperature at an average cooling rate of 5° C./s.

Note that although the "rapid cooling stop temperature T (° C.)" and "end temperature (° C.)" in the T1 temperature region and the "holding temperature (° C.)" in the T2 temperature region are deviated from the T1 temperature region or the T2 temperature region specified in the present invention in some of the examples shown in Tables 2 and 3, temperature was written in each field to show the heat pattern for convenience of description.

For example, a sample of No. 30 is an example in which, after being cooled to the "rapid cooling stop temperature T (° C.)" of 170° C. in the T1 temperature region after soaking, the sample was immediately heated up to the T2 temperature region without being held at the temperature T (thus, the end temperature is 170° C. equal to the above temperature T, "holding time at rapid cooling stop temperature T (s) of 0 second) and almost without being held also in the T1 temperature region for the "holding time in T1 (s)" of 4 seconds.

For some of the samples obtained by continuous annealing, a plating treatment described below was applied to obtain EG steel sheets, GA steel sheets and GI steel sheets after cooling up to the room temperature.

[Electro-Galvanizing (EG) Treatment]

After the electro-galvanizing treatment was applied at a current density of 30 to 50 A/dm$^2$ to the sample immersed in an electro-galvanizing bath of 55° C., the sample was washed with water and dried to obtain an EG steel sheet. A galvanizing coating weight was set at 10 to 100 g/m$^2$ per surface.

[Hot Dip Galvanizing (GI) Treatment]

After the plating treatment was applied to the sample immersed in a hot dip galvanizing bath of 450° C., the sample was cooled to the room temperature to obtain a GI steel sheet. A galvanizing coating weight was set at 10 to 100 g/m$^2$ per surface.

[Alloyed Hot Dip Galvanizing (GA) Treatment]

After being immersed in the hot dip galvanizing bath, the alloying treatment was further applied at 500° C. and, then, the sample was cooled to the room temperature to obtain a GI steel sheet.

Note that Nos. 57 and 60 are examples in which the hot dip galvanizing (GI) treatment was subsequently applied in the T2 temperature region without cooling after the sample was continuously annealed in accordance with a predetermined pattern. Specifically, No. 57 is an example in which hot dip galvanizing was subsequently applied by immersing the sample in the hot dip galvanizing bath of 460° C. for 5 seconds without cooling after the sample was held at the "holding temperature (° C.)" of 440° C. in the T2 temperature region shown in Table 3 for 100 seconds and, then, the sample was cooled at an average cooling rate of 5° C./s up to the room temperature after being gradually cooled up to 440° C. for 20 seconds. Further, No. 60 is an example in which hot dip galvanizing was subsequently applied by immersing the sample in the hot dip galvanizing bath of 460° C. for 5 seconds without cooling after the sample was held at the "holding temperature (° C.)" of 420° C. in the T2 temperature region shown in Table 3 for 150 seconds and, then, the sample was cooled at an average cooling rate of 5° C./s up to the room temperature after being gradually cooled up to 440° C. for 20 seconds.

Further, Nos. 58, 61 and 65 are examples in which hot dip galvanizing and the alloying treatment were subsequently applied in the T2 temperature region without cooling after the sample was continuously annealed in accordance with the predetermined pattern. Specifically, these are examples in which hot dip galvanizing was subsequently applied by immersing the sample in the hot dip galvanizing bath of 460° C. for 5 seconds without cooling after the sample was held at the "holding temperature (° C.)" in the T2 temperature region shown in Table 3 for a predetermined time and, then, the sample was heated to 500° C. and held at this temperature to perform the alloying treatment and cooled at an average cooling rate of 5° C./s up to the room temperature.

In the above plating treatment, degreasing through immersion in alkaline solution, a cleaning treatment such as washing with water or acid were appropriately performed.

Classification of the obtained samples is shown in a column of "Cold Rolled/Plating Classification" of Tables 2 and 3 below. In Tables 2 and 3, "Cold Rolled" indicates a cold rolled steel sheet, "EG" indicates an EG steel sheet, "GI" indicates a GI steel sheet and "GA" indicates a GA steel sheet.

The observation of a metal structure and the evaluation of mechanical properties were conducted in the following procedure for the obtained samples (mean to include cold rolled steel sheets, EG steel sheets, GI steel sheets and GA steel sheets. The same applies to the following.)

<<Observation of Metal Structure>>

Out of the metal structure, an area percent of each of high-temperature region generated bainite and low-temperature region generated bainite and the like and polygonal ferrite was calculated based on an SEM observation result and a volume percent of retained γ was measured by the saturation magnetization method.

[Area Percent of High-Temperature Region Generated Bainite, Low-Temperature Region Generated Bainite and the Like and Polygonal Ferrite]

After a surface of a cross-section of the sample parallel to a rolling direction was polished, nital corrosion was caused and five view fields at a ¼ thickness position were observed at a magnification of 3000 by an SEM. The view fields were about 50 μm×about 50 μm.

Subsequently, average intervals of retained γ and carbide observed in white or light gray were measured based on the aforementioned method in the observation view fields. The area percent of each of high-temperature region generated bainite and low-temperature region generated bainite and the like distinguished by these average intervals was measured by point arithmetic.

An area percent a (area %) of polygonal ferrite, an area percent b (area %) of high-temperature region generated bainite and a total area percent c (area %) of low-temperature region generated bainite and tempered martensite are shown in Tables 4 and 5 below. In Tables 4 and 5, B denotes bainite, M denotes martensite and PF denotes polygonal ferrite. Further, the total area percent (area %) of the area percent a, the area percent b and the total area percent c is also shown.

Further, circle-equivalent diameters of polygonal ferrite grains confirmed in the observation view fields were measured and an average value was obtained. A result is shown in a column of "Average Circle-Equivalent Diameter D of PF (μm)" of Tables 4 and 5 below.

[Volume Percent of Retained γ]

Out of the metal structure, the volume percent of retained γ was measured by the saturation magnetization method. Specifically, a saturation magnetization (I) of the sample and a saturation magnetization (Is) of a standard sample heated at 400° C. for 15 hours were measured and the volume percent (Vγr) of retained γ was obtained from the following Equation. The saturation magnetization was measured at the room temperature with a maximum applied magnetization set at 5000 (Oe) using an automatic direct-current magnetization B-H characteristic recording device "Model BHS-40" produced by Riken Denshi Co., Ltd.

$$V\gamma r=(1-I/Is)\times 100$$

Further, the surface of the cross-section of the sample parallel to the rolling direction was polished, Repera corrosion was caused, five view fields at the ¼ thickness position were observed at a magnification of 1000 using an optical microscope and circle-equivalent diameters d of MA mixed phases in which retained γ and quenched martensite were compounded were measured. A ratio of the number of the MA mixed phases whose circle-equivalent diameters were larger than 7 μm in the observed cross-section to the total number of the MA mixed phases was calculated. An evaluation result is shown in a column of "Evaluation Result on MA Mixed Phase Number Ratio" of Tables 4 and 5 below with a case where the number ratio is below 15% (including 0%) as good (OK) and a case where the number ratio is not lower than 15% as not good (NG).

[IQ Distribution]

A surface of a cross-section of the sample parallel to the rolling direction was polished and an EBSD measurement (OIM system produced by TexSEM Laboratories Inc.) was conducted at 180,000 points with one step of 0.25 μm for an area of 100 μm×100 μm at a ¼ thickness position. From this measurement result, an average IQ value in each grain was obtained. Note that only crystal grains completely accommodated in the measurement area were measured and measurement points of CI<0.1 were excluded from analysis. Further, in Equations (1) and (2) below, 2% of the total number of data was excluded on each of maximum and minimum sides. A value of (IQave−IQmin)/(IQmax−IQmin) was written in "Equation (1)" and a value of (σIQ)/(IQmax−IQmin) was written in "Equation (2) in Tables 4 and 5.

$$(IQave-IQmin)/(IQmax-IQmin)\geq 0.40 \quad (1)$$

$$(\sigma IQ)/(IQmax-IQmin)\leq 0.25 \quad (2)$$

<<Evaluation of Mechanical Properties>>

[Tensile Strength (TS), Elongation (EL)]

Tensile strength (TS) and elongation (EL) were measured by conducting a tensile test based on JIS Z2241. A test piece used was a test piece No. 5 specified by JIS Z2201 cut out from a sample such that a direction perpendicular to the rolling direction of the sample is a longitudinal direction. A measurement result is shown in each of columns of "TS (MPa)" and "EL (%)" of Tables 6 and 7 below.

[Low-Temperature Toughness]

Low-temperature toughness was evaluated by a brittle fracture rate (%) when a Charpy impact test was conducted at −20° C. based on JIS Z2242. A width of a test piece was 1.4 mm equal to the sheet thickness. The test piece used was a V notch test piece cut out from the sample such that a direction perpendicular to the rolling direction of the sample is a longitudinal direction. A measurement result is shown in a column of "Low-Temperature Toughness (%)" of Tables 6 and 7 below.

[Stretch Flange Formability (1)]

Stretch flange formability (λ) was evaluated by a hole expansion ratio. The hole expansion ratio (λ) was measured by conducting a hole expansion test based on the Japan Iron and Steel Federation's standard JFST 1001. A measurement result is shown in a column of ", (%)" of Tables 6 and 7 below.

[Bendability (R)]

Bendability (R) was evaluated by a limit bending radius. The limit bending radius was measured by conducting a V bending test based on JIS Z2248. A test piece used was a test piece No. 1 specified by JIS Z2204, having a sheet thickness of 1.4 mm and cut out from a sample such that a direction perpendicular to the rolling direction of the sample is a longitudinal direction, i.e. a bending ridge coincides with the rolling direction. Note that the V bending test was conducted after end surfaces of the test piece in the longitudinal direction were machine-ground so as not to cause cracks.

With angles of a die and a punch set at 90°, the V bending test was conducted by changing a tip radius of the punch in increments of 0.5 mm and the tip radius of the punch capable of bending the test piece without causing cracks was obtained as the limit bending radius. A measurement result is shown in a column of "Limit Bending R (mm)" of Tables 6 and 7 below. Note that the presence or absence of cracks was observed using a loupe and determined on the basis of the absence of hair cracks.

[Erichsen Value]

An Erichsen value was measured by conducting an Erichsen test based on JIS Z2247. A test piece used was cut out from the sample to be 90 mm×90 mm×1.4 mm (thickness). The Erichsen test was conducted using a punch having a diameter of 20 mm. A measurement result is shown in a column of "Erichsen Value (mm)" of Tables 6 and 7 below.

Note that, according to the Erichsen test, composite effects by both the total elongation property and local ductility of the steel sheet can be evaluated.

Since elongation (EL) required for steel sheets differs depending on tensile strength (TS), elongation (EL) was evaluated according to tensile strength (TS). Similarly, standards of other preferable mechanical properties such as stretch flange formability (λ), bendability (R) and the Erichsen value were also set according to tensile strength (TS). Low-temperature toughness was uniformly determined to be good if the brittle fracture rate was 10% or lower in the Charpy impact test at −20° C.

Based on evaluation criteria below, a case where elongation (EL) and low-temperature toughness were satisfied was determined to be excellent in ductility and low-temperature toughness (good). Further, a case where all of elongation (EL), stretch flange formability (λ), bendability (R), the Erichsen value and low-temperature toughness were satisfied was determined to be excellent in processability and low-temperature toughness (excellent). Good or excellent is a successful example. Contrary to this, a case where either elongation (EL) or low-temperature toughness was below a reference value was determined to be unsuccessful (not good). An evaluation result is shown in a column of "Comprehensive Evaluation" of Tables 6 and 7 below.

[Level of 780 MPa]

Tensile strength (TS): 780 MPa or more, below 980 MPa

Elongation (EL): 25% or higher

Low-Temperature toughness: 10% or lower

Stretch flange formability (λ): 30% or higher

Bendability (R): 1.0 mm or less

Erichsen value: 10.4 mm or more

[Level of 980 MPa]

Tensile strength (TS): 980 MPa or more, below 1180 MPa

Elongation (EL): 19% or higher

Low-Temperature toughness: 10% or lower

Stretch flange formability (λ): 20% or higher

Bendability (R): 3.0 mm or less

Erichsen value: 10.0 mm or more

[Level of 1180 MPa]

Tensile strength (TS): 1180 MPa or more, below 1270 MPa

Elongation (EL): 15% or higher

Low-Temperature toughness: 10% or lower

Stretch flange formability (λ): 20% or higher

Bendability (R): 4.5 mm or less

Erichsen value: 9.6 mm or more

[Level of 1270 MPa]

Tensile strength (TS): 1270 MPa or more, below 1370 MPa

Elongation (EL): 14% or higher

Low-Temperature toughness: 10% or lower

Stretch flange formability (λ): 20% or higher

Bendability (R): 5.5 mm or less

Erichsen value: 9.4 mm or more

Note that the present invention assumes that tensile strength (TS) is 780 MPa or more and below 1370 MP and cases where tensile strength (TS) is below 780 MPa or 1370 MPa or more are exempted even if mechanical properties are good. These are written as "-" in a column of "Remarks" of Tables 6 and 7 below.

TABLE 1

| Steel | Component (mass %) | | | | | | | | | | | |
|---|---|---|---|---|---|---|---|---|---|---|---|---|
| Type | C | Si | Mn | P | S | Al | Cr | Mo | Ti | Nb | V | Cu |
| A | 0.12 | 1.37 | 2.43 | 0.02 | 0.002 | 0.02 | — | — | — | — | — | — |
| B | 0.20 | 1.74 | 2.10 | 0.02 | 0.002 | 0.05 | — | — | — | — | — | — |
| C | 0.16 | 2.16 | 2.28 | 0.02 | 0.002 | 0.02 | — | — | — | — | — | — |
| D | 0.20 | 1.56 | 2.63 | 0.01 | 0.002 | 0.04 | — | — | — | — | — | — |
| E | 0.31 | 1.24 | 1.53 | 0.01 | 0.001 | 0.02 | — | — | — | — | — | — |
| F | 0.42 | 1.24 | 1.76 | 0.03 | 0.002 | 0.04 | — | — | — | — | — | — |
| G | 0.19 | 1.35 | 1.89 | 0.02 | 0.002 | 0.05 | 0.4 | — | — | — | — | |
| H | 0.19 | 1.39 | 1.88 | 0.03 | 0.002 | 0.02 | — | 0.3 | — | — | — | — |
| I | 0.20 | 1.32 | 2.05 | 0.02 | 0.002 | 0.01 | — | — | 0.12 | — | — | — |
| J | 0.20 | 1.36 | 2.05 | 0.02 | 0.003 | 0.03 | — | — | — | 0.11 | — | — |
| K | 0.19 | 1.34 | 2.00 | 0.01 | 0.001 | 0.03 | — | — | — | — | 0.13 | — |
| L | 0.20 | 1.36 | 2.03 | 0.02 | 0.002 | 0.01 | — | — | — | — | — | 0.21 |
| M | 0.15 | 1.52 | 2.86 | 0.03 | 0.002 | 0.05 | — | — | — | — | — | — |
| N | 0.19 | 1.91 | 2.54 | 0.03 | 0.001 | 0.03 | — | — | 0.02 | — | — | — |
| O | 0.23 | 1.27 | 2.22 | 0.02 | 0.003 | 0.03 | — | — | — | — | — | — |
| P | 0.21 | 1.54 | 2.08 | 0.01 | 0.002 | 0.05 | — | — | — | — | — | — |
| Q | 0.16 | 1.17 | 2.42 | 0.02 | 0.001 | 0.02 | — | — | — | — | — | — |
| R | 0.28 | 1.21 | 1.65 | 0.02 | 0.001 | 0.02 | — | — | — | — | — | — |
| S | 0.22 | 1.08 | 2.21 | 0.02 | 0.002 | 0.45 | — | — | — | — | — | — |
| T | 0.17 | 2.36 | 2.29 | 0.02 | 0.003 | 0.01 | — | — | — | — | — | — |
| U | 0.18 | 1.81 | 2.89 | 0.02 | 0.002 | 0.25 | — | — | — | — | — | — |
| V | 0.17 | 2.02 | 2.22 | 0.02 | 0.002 | 0.04 | — | — | 0.08 | — | — | — |
| W | 0.09 | 1.56 | 2.44 | 0.01 | 0.002 | 0.02 | — | — | — | — | — | — |
| X | 0.18 | 0.46 | 2.08 | 0.02 | 0.002 | 0.04 | — | — | — | — | — | — |
| Y | 0.18 | 1.58 | 1.23 | 0.03 | 0.002 | 0.04 | — | — | — | — | — | — |
| Z | 0.21 | 1.80 | 1.80 | 0.02 | 0.001 | 0.04 | — | — | — | — | — | — |

| Steel | Component (mass %) | | | | | | | $Ac_3$ |
|---|---|---|---|---|---|---|---|---|
| Type | Ni | B | Ca | Mg | REM | N | O | Point (° C.) |
| A | — | — | — | — | — | 0.003 | 0.001 | 850 |
| B | — | — | — | — | — | 0.003 | 0.002 | 868 |
| C | — | — | — | — | — | 0.004 | 0.001 | 868 |
| D | — | — | — | — | — | 0.004 | 0.002 | 834 |
| E | — | — | — | — | — | 0.003 | 0.001 | 821 |

TABLE 1-continued

| | | | | | | | | |
|---|---|---|---|---|---|---|---|---|
| F | — | 0.0002 | — | — | — | 0.002 | 0.001 | 819 |
| G | — | — | — | — | — | 0.003 | 0.002 | 855 |
| H | — | — | — | — | — | 0.004 | 0.001 | 866 |
| I | — | | — | — | — | 0.004 | 0.001 | 883 |
| J | — | — | — | — | — | 0.004 | 0.001 | 846 |
| K | — | — | — | — | — | 0.004 | 0.001 | 854 |
| L | 0.21 | — | — | — | — | 0.003 | 0.001 | 831 |
| M | — | 0.0023 | — | — | — | 0.002 | 0.001 | 854 |
| N | — | 0.0004 | — | — | — | 0.003 | 0.001 | 871 |
| O | — | — | 0.0020 | — | — | 0.004 | 0.001 | 828 |
| P | — | — | — | 0.0026 | — | 0.003 | 0.002 | 850 |
| Q | — | — | — | — | 0.0021 | 0.004 | 0.001 | 830 |
| R | — | — | — | — | — | 0.003 | 0.001 | 829 |
| S | — | — | — | — | — | 0.002 | 0.001 | 890 |
| T | — | — | — | — | — | 0.005 | 0.002 | 881 |
| U | — | — | — | — | — | 0.002 | 0.002 | 831 |
| V | — | — | — | — | — | 0.005 | 0.001 | 912 |
| W | — | — | — | — | — | 0.005 | 0.001 | 862 |
| X | — | — | — | — | — | 0.003 | 0.002 | 813 |
| Y | — | — | — | — | — | 0.002 | 0.002 | 895 |
| Z | — | — | — | — | — | 0.004 | 0.001 | 873 |

TABLE 2

| | | II | | | | VII | | | | | | XIV | | | | |
|---|---|---|---|---|---|---|---|---|---|---|---|---|---|---|---|---|
| No. | I | III | IV | V | VI | VIII | IX | X | XI | XII | XIII | XV | XVI | XVII | XVIII | XIX |
| 1 | A | 840 | 835 | 200 | 30 | 388 | 300 | 280 | 20 | 38 | 20 | 440 | 100 | 113 | ii | Cold Rolled |
| 2 | | | 835 | 200 | 30 | 387 | 200 | 200 | 30 | 65 | 30 | 410 | 60 | 63 | i | Cold Rolled |
| 3 | | | 835 | 200 | 30 | 384 | 120 | 140 | 20 | 58 | 60 | 440 | 150 | 168 | — | Cold Rolled |
| 4 | | | 860 | 200 | 30 | 423 | 250 | 250 | 20 | 64 | 50 | 440 | 80 | 99 | i | Cold Rolled |
| 5 | | | 835 | 200 | 30 | 393 | 420 | 420 | 30 | 0 | 20 | 320 | 100 | 0 | — | Cold Rolled |
| 6 | | | 830 | 200 | 50 | 382 | 180 | 200 | 30 | 117 | 100 | 440 | 100 | 125 | iii | GI |
| 7 | | | 830 | 200 | 30 | 385 | 410 | 420 | 50 | 0 | 10 | 430 | 100 | 106 | — | Cold Rolled |
| 8 | B | 858 | 830 | 200 | 30 | 329 | 200 | 200 | 50 | 145 | 100 | 420 | 100 | 113 | i | Cold Rolled |
| 9 | | | 830 | 200 | 50 | 332 | 165 | 160 | 10 | 17 | 5 | 450 | 150 | 161 | ii | Cold Rolled |
| 10 | | | 800 | 450 | 30 | 318 | 250 | 280 | 10 | 33 | 25 | 425 | 150 | 159 | iii | Cold Rolled |
| 11 | | | 850 | 80 | 50 | 364 | 180 | 180 | 30 | 112 | 80 | 405 | 150 | 153 | i | Cold Rolled |
| 12 | | | 760 | 200 | 30 | 258 | 170 | 200 | 20 | 63 | 50 | 450 | 200 | 220 | iii | Cold Rolled |
| 13 | | | 845 | 200 | 50 | 351 | 200 | 200 | 20 | 96 | 80 | 420 | 150 | 161 | i | GA |
| 14 | | | 830 | 200 | 30 | 337 | 440 | 440 | 30 | 0 | 20 | 380 | 100 | 0 | — | Cold Rolled |
| 15 | | | 830 | 200 | 30 | 321 | 160 | 160 | 150 | 185 | 30 | 405 | 50 | 52 | i | EG |
| 16 | | | 830 | 200 | 30 | 335 | 410 | 410 | 30 | 0 | 10 | 430 | 150 | 156 | — | Cold Rolled |
| 17 | C | 868 | 850 | 200 | 30 | 356 | 345 | 385 | 30 | 58 | 100 | 440 | 150 | 231 | iii | Cold Rolled |
| 18 | | | 855 | 200 | 30 | 360 | 200 | 200 | 70 | 191 | 145 | 450 | 150 | 189 | i | Cold Rolled |
| 19 | | | 855 | 200 | 50 | 364 | 220 | 200 | 7 | 12 | 2 | 420 | 150 | 154 | ii | Cold Rolled |
| 20 | | | 850 | 200 | 30 | 360 | 155 | 150 | 20 | 64 | 50 | 490 | 70 | 101 | ii | Cold Rolled |
| 21 | | | 855 | 200 | 50 | 368 | 170 | 170 | 10 | 18 | 5 | 440 | 150 | 159 | i | Cold Rolled |
| 22 | | | 840 | 10 | 30 | 276 | 220 | 250 | 30 | 47 | 20 | 450 | 150 | 165 | iii | Cold Rolled |
| 23 | | | 850 | 200 | 30 | 358 | 380 | 380 | 20 | 32 | 35 | 440 | 150 | 158 | — | Cold Rolled |
| 24 | | | 840 | 200 | 5 | 281 | 200 | 200 | 20 | 76 | 50 | 450 | 150 | 170 | i | Cold Rolled |
| 25 | | | 855 | 200 | 50 | 366 | 175 | 170 | 15 | 35 | 20 | 450 | 150 | 164 | ii | GI |
| 26 | | | 850 | 200 | 30 | 360 | 160 | 180 | 40 | 95 | 50 | 410 | 100 | 104 | iii | EG |
| 27 | D | 824 | 820 | 200 | 15 | 357 | 160 | 160 | 30 | 172 | 140 | 420 | 50 | 65 | i | Cold Rolled |
| 28 | | | 815 | 200 | 20 | 345 | 180 | 200 | 10 | 36 | 20 | 420 | 100 | 106 | iii | Cold Rolled |
| 29 | | | 810 | 200 | 30 | 331 | 310 | 370 | 100 | 195 | 220 | 440 | 100 | 234 | iii | Cold Rolled |
| 30 | | | 810 | 200 | 50 | 328 | 170 | 170 | 0 | 4 | 1 | 460 | 50 | 162 | iii | Cold Rolled |
| 31 | | | 810 | 200 | 30 | 331 | 200 | 200 | 20 | 224 | 50 | 400 | 150 | 0 | — | Cold Rolled |
| 32 | | | 815 | 200 | 30 | 346 | 80 | 100 | 30 | 56 | 65 | 440 | 150 | 175 | — | GA |
| 33 | | | 810 | 200 | 30 | 335 | 350 | 340 | 10 | 44 | 20 | 430 | 100 | 113 | ii | Cold Rolled |
| 34 | E | 811 | 805 | 200 | 30 | 313 | 290 | 290 | 30 | 73 | 50 | 420 | 150 | 162 | i | Cold Rolled |
| 35 | | | 805 | 200 | 30 | 310 | 160 | 180 | 30 | 116 | 100 | 450 | 150 | 178 | iii | Cold Rolled |
| 36 | | | 805 | 200 | 50 | 313 | 200 | 180 | 100 | 231 | 140 | 420 | 150 | 166 | ii | Cold Rolled |
| 37 | | | 805 | 200 | 30 | 315 | 250 | 220 | 15 | 56 | 50 | 450 | 150 | 171 | ii | GI |
| 38 | | | 805 | 200 | 20 | 313 | 180 | 180 | 30 | 82 | 50 | 420 | 150 | 158 | i | GA |
| 39 | | | 805 | 200 | 40 | 310 | 160 | 180 | 100 | 150 | 50 | 420 | 20 | 28 | iii | Cold Rolled |
| 40 | F | 809 | 800 | 200 | 15 | 256 | 155 | 150 | 50 | 148 | 120 | 480 | 50 | 95 | ii | Cold Rolled |
| 41 | | | 800 | 200 | 15 | 200 | 200 | 200 | 30 | 55 | 50 | 600 | 100 | 0 | — | Cold Rolled |
| 42 | | | 800 | 200 | 15 | 262 | 180 | 160 | 30 | 77 | 50 | 450 | 20 | 39 | ii | Cold Rolled |

TABLE 2-continued

| | | II | | | | VII | | | | | | XIV | | | | |
|---|---|---|---|---|---|---|---|---|---|---|---|---|---|---|---|---|
| No. | I | III | IV | V | VI | VIII | IX | X | XI | XII | XIII | XV | XVI | XVII | XVIII | XIX |
| 43 | G | 845 | 835 | 200 | 20 | 353 | 200 | 200 | 20 | 69 | 50 | 440 | 200 | 216 | i | Cold Rolled |
| 44 | | | 880 | 200 | 50 | 387 | 430 | 430 | 40 | 0 | 10 | 350 | 550 | 0 | — | Cold Rolled |

I: Steel Type,
II: Soaking,
III: $Ac_3$-10° C. (° C.)
IV: Soaking Temperature (° C.),
V: Soaking Time (s),
VI: Average Cooling Rate (° C./S),
VII: T1 Temperature Region,
VIII: Ms Point (° C.),
IX: Rapid cooling stop Temperature T (° C.),
X: End Temperature (° C.),
XI: Holding Time at T or Holding Time from T to Cooling End Temperature or Heating End Temperature (s),
XII: Holding Time in T1 (s),
XIII: Time of T1→T2 (s),
XIV: T2 Temperature Region,
XV: Holding Temperature (° C.),
XVI: Holding Time at Holding Temperature (s),
XVII: Holding Time in T2 (s),
XVIII: Pattern (i: holding, ii: gradual cooling, iii: gradual heating),
XIV: Cold Rolled/Plating Classification

TABLE 3

| | | II | | | | VII | | | | | | XIV | | | | |
|---|---|---|---|---|---|---|---|---|---|---|---|---|---|---|---|---|
| No. | I | III | IV | V | VI | VIII | IX | X | XI | XII | XIII | XV | XVI | XVII | XVIII | XIX |
| 45 | H | 856 | 840 | 200 | 20 | 360 | 180 | 180 | 30 | 63 | 30 | 450 | 150 | 166 | i | Cold Rolled |
| 46 | | | 830 | 200 | 20 | 354 | 340 | 340 | 5 | 9 | 5 | 440 | 180 | 162 | i | Cold Rolled |
| 47 | I | 873 | 850 | 200 | 20 | 349 | 160 | 180 | 30 | 85 | 50 | 420 | 200 | 208 | iii | Cold Rolled |
| 48 | J | 836 | 830 | 200 | 150 | 351 | 200 | 220 | 50 | 101 | 50 | 440 | 150 | 167 | iii | Cold Rolled |
| 49 | K | 844 | 835 | 200 | 30 | 364 | 200 | 180 | 30 | 52 | 20 | 450 | 150 | 164 | ii | Cold Rolled |
| 50 | L | 821 | 810 | 200 | 20 | 344 | 180 | 180 | 20 | 56 | 40 | 500 | 50 | 82 | i | Cold Rolled |
| 51 | M | 844 | 830 | 200 | 20 | 345 | 160 | 160 | 30 | 65 | 30 | 440 | 200 | 212 | i | Cold Rolled |
| 52 | N | 861 | 845 | 200 | 20 | 345 | 180 | 220 | 30 | 171 | 140 | 410 | 200 | 209 | iii | Cold Rolled |
| 53 | | | 840 | 200 | 20 | 337 | 200 | 220 | 20 | 54 | 25 | 405 | 400 | 402 | iii | Cold Rolled |
| 54 | | | 840 | 200 | 20 | 343 | 17 | 200 | 20 | 61 | 30 | 405 | 600 | 602 | iii | Cold Rolled |
| 55 | | | 835 | 200 | 15 | 335 | 320 | 340 | 5 | 7 | 1 | 410 | 200 | 202 | iii | Cold Rolled |
| 56 | O | 818 | 805 | 200 | 20 | 309 | 160 | 180 | 10 | 34 | 20 | 440 | 150 | 161 | iii | Cold Rolled |
| 57 | | | 805 | 200 | 20 | 312 | 200 | 200 | 30 | 77 | 50 | 440 | 100 | 141 | i | GI |
| 58 | | | 805 | 200 | 20 | 303 | 155 | 160 | 100 | 195 | 95 | 420 | 100 | 152 | iii | GA |
| 59 | P | 84 | 820 | 200 | 20 | 330 | 300 | 300 | 50 | 87 | 50 | 440 | 150 | 172 | i | Cold Rolled |
| 60 | | | 820 | 100 | 20 | 327 | 250 | 220 | 10 | 18 | 5 | 420 | 150 | 183 | ii | GI |
| 61 | | | 830 | 200 | 50 | 348 | 160 | 180 | 20 | 52 | 30 | 410 | 150 | 196 | iii | GA |
| 62 | | | 830 | 200 | 40 | 339 | 430 | 430 | 550 | 0 | — | — | — | 0 | — | Cold Rolled |
| 63 | O | 820 | 805 | 200 | 20 | 341 | 200 | 200 | 30 | 55 | 20 | 420 | 150 | 156 | i | Cold Rolled |
| 64 | R | 819 | 810 | 200 | 50 | 330 | 180 | 180 | 50 | 80 | 30 | 420 | 100 | 106 | i | Cold Rolled |
| 65 | S | 980 | 900 | 200 | 30 | 298 | 155 | 155 | 10 | 17 | 2 | 420 | 50 | 95 | i | GA |
| 66 | T | 871 | 850 | 200 | 30 | 338 | 200 | 200 | 100 | 140 | 50 | 480 | 100 | 130 | i | Cold Rolled |
| 67 | U | 921 | 880 | 200 | 30 | 319 | 180 | 180 | 50 | 79 | 30 | 450 | 100 | 116 | i | Cold Rolled |
| 68 | V | 902 | 900 | 200 | 30 | 356 | 450 | 420 | 40 | 44 | 4 | 350 | 625 | 633 | — | Cold Rolled |
| 69 | W | 852 | 840 | 200 | 30 | 402 | 200 | 200 | 30 | 53 | 20 | 440 | 150 | 161 | i | Cold Rolled |
| 70 | X | 803 | 800 | 200 | 30 | 382 | 200 | 200 | 30 | 53 | 20 | 440 | 150 | 161 | i | Cold Rolled |
| 71 | Y | 885 | 860 | 200 | 30 | 266 | 200 | 200 | 30 | 57 | 30 | 440 | 150 | 163 | i | Cold Rolled |
| 72 | Z | 863 | 830 | 70 | 20 | 327 | 150 | 150 | 10 | 27 | 5 | 420 | 40 | 85 | i | GA |

I: Steel Type,
II: Soaking,
III: $Ac_3$-10° C. (° C.)
IV: Soaking Temperature (° C.),
V: Soaking Time (s),
VI: Average Cooling Rate (° C./S),
VII: T1 Temperature Region,
VIII: Ms Point (° C.),
IX: Rapid cooling stop Temperature T (° C.),
X: End Temperature (° C.),
XI: Holding Time at T or Holding Time from T to Cooling End Temperature or Heating End Temperature (s),
XII: Holding Time in T1 (s),
XIII: Time of T1→T2 (s), TABLE 3-continued

| | | II | | | | VII | | | | | | XIV | | | | |
|---|---|---|---|---|---|---|---|---|---|---|---|---|---|---|---|---|
| No. | I | III | IV | V | VI | VIII | IX | X | XI | XII | XIII | XV | XVI | XVII | XVIII | XIX |

XIV: T2 Temperature Region,

XV: Holding Temperature (° C.),

XVI: Holding Time at Holding Temperature (s),

XVII: Holding Time in T2 (s),

XVIII: Pattern (i: holding, ii: gradual cooling, iii: gradual heating),

XIV: Cold Rolled/Plating Classification

TABLE 4

| | | Structure Fraction | | | | | | | IQ Distribution | |
|---|---|---|---|---|---|---|---|---|---|---|
| No. | Steel Type | Area Percent a of PF (Area %) | Area Percent b of High-Temp Region B (Area %) | Area Percent c of Low-Temp Region B + Tempered M (Area %) | Total Area of a + b + c (Area %) | Volume Percent of Retained γ (Volume %) | Evaluation Result on Number Ratio of MA Mixed Phases | Average Circle-Equivalent Diameter D of PF (μm) | Equation (1) | Equation (2) |
| 1 | A | 38 | 25 | 29 | 92 | 12 | OK | 5 | 0.47 | 0.24 |
| 2 | | 39 | 21 | 35 | 95 | 10 | OK | 5 | 0.52 | 0.21 |
| 3 | | 41 | 6 | 51 | 98 | 4 | OK | 5 | 0.57 | 0.21 |
| 4 | | 0 | 26 | 68 | 94 | 8 | OK | — | 0.51 | 0.23 |
| 5 | | 35 | 51 | 8 | 94 | 13 | NG | 5 | 0.35 | 0.27 |
| 6 | | 42 | 22 | 31 | 95 | 11 | OK | 5 | 0.55 | 0.20 |
| 7 | | 40 | 50 | 5 | 95 | 6 | NG | 6 | 0.36 | 0.26 |
| 8 | B | 41 | 17 | 35 | 93 | 14 | OK | 6 | 0.53 | 0.22 |
| 9 | | 40 | 21 | 32 | 93 | 15 | OK | 5 | 0.51 | 0.25 |
| 10 | | 45 | 28 | 22 | 95 | 13 | OK | 4 | 0.49 | 0.24 |
| 11 | | 25 | 28 | 40 | 93 | 12 | OK | 11 | 0.54 | 0.21 |
| 12 | | 59 | 15 | 24 | 98 | 10 | OK | 4 | 0.54 | 0.22 |
| 13 | | 32 | 27 | 33 | 92 | 14 | OK | 5 | 0.52 | 0.23 |
| 14 | | 38 | 45 | 7 | 90 | 15 | NG | 5 | 0.31 | 0.29 |
| 15 | | 44 | 9 | 44 | 97 | 8 | OK | 6 | 0.55 | 0.22 |
| 16 | | 39 | 52 | 2 | 93 | 11 | NG | 5 | 0.37 | 0.27 |
| 17 | C | 40 | 31 | 19 | 90 | 14 | OK | 5 | 0.54 | 0.24 |
| 18 | | 38 | 21 | 35 | 94 | 13 | OK | 7 | 0.58 | 0.21 |
| 19 | | 36 | 26 | 28 | 90 | 14 | OK | 6 | 0.51 | 0.24 |
| 20 | | 38 | 25 | 31 | 94 | 13 | OK | 5 | 0.54 | 0.22 |
| 21 | | 34 | 31 | 26 | 91 | 14 | OK | 6 | 0.57 | 0.22 |
| 22 | | 63 | 12 | 14 | 89 | 4 | OK | 12 | 0.49 | 0.24 |
| 23 | | 39 | 46 | 6 | 91 | 15 | NG | 5 | 0.37 | 0.26 |
| 24 | | 62 | 15 | 8 | 85 | 3 | OK | 13 | 0.51 | 0.24 |
| 25 | | 35 | 22 | 32 | 89 | 14 | OK | 5 | 0.55 | 0.21 |
| 26 | | 38 | 16 | 36 | 90 | 12 | OK | 5 | 0.54 | 0.22 |
| 27 | D | 20 | 23 | 47 | 90 | 12 | OK | 6 | 0.54 | 0.22 |
| 28 | | 28 | 23 | 39 | 90 | 12 | OK | 5 | 0.50 | 0.23 |
| 29 | | 35 | 21 | 37 | 93 | 13 | OK | 5 | 0.56 | 0.22 |
| 30 | | 36 | 47 | 6 | 89 | 15 | NG | 5 | 0.37 | 0.28 |
| 31 | | 35 | 7 | 58 | 100 | 4 | OK | 5 | 0.47 | 0.25 |
| 32 | | 27 | 8 | 63 | 98 | 4 | OK | 5 | 0.57 | 0.21 |
| 33 | | 33 | 53 | 5 | 91 | 11 | NG | 6 | 0.38 | 0.26 |
| 34 | E | 25 | 35 | 28 | 88 | 16 | OK | 5 | 0.51 | 0.23 |
| 35 | | 26 | 22 | 39 | 87 | 14 | OK | 5 | 0.58 | 0.22 |
| 36 | | 25 | 6 | 59 | 90 | 4 | OK | 5 | 0.57 | 0.23 |
| 37 | | 24 | 33 | 32 | 89 | 14 | OK | 4 | 0.48 | 0.24 |
| 38 | | 25 | 28 | 42 | 95 | 12 | OK | 5 | 0.54 | 0.22 |
| 39 | | 26 | 7 | 46 | 79 | 14 | NG | 4 | 0.39 | 0.22 |
| 40 | F | 20 | 26 | 44 | 90 | 12 | OK | 5 | 0.54 | 0.22 |
| 41 | | 35 | 5 | 38 | 78 | 4 | OK | 5 | 0.43 | 0.25 |
| 42 | | 18 | 7 | 40 | 65 | 18 | NG | 5 | 0.32 | 0.24 |
| 43 | G | 35 | 26 | 28 | 89 | 14 | OK | 5 | 0.57 | 0.22 |
| 44 | | 0 | 53 | 35 | 88 | 16 | OK | — | 0.51 | 0.26 |

TABLE 5

| | | Structure Fraction | | | | | | | IQ Distribution | |
|---|---|---|---|---|---|---|---|---|---|---|
| No. | Steel Type | Area Percent a of PF (Area %) | Area Percent b of High-Temp Region B (Area %) | Area Percent c of Low-Temp Region B + Tempered M (Area %) | Total Area of a + b + c (Area %) | Volume Percent of Retained γ (Volume %) | Evaluation Result on Number Ratio of MA Mixed Phases | Average Circle-Equivalent Diameter D of PF (μm) | Equation (1) | Equation (2) |
| 45 | H | 31 | 32 | 25 | 88 | 14 | OK | 5 | 0.58 | 0.22 |
| 46 | | 34 | 46 | 9 | 89 | 10 | NG | 5 | 0.38 | 0.26 |
| 47 | I | 35 | 23 | 30 | 88 | 15 | OK | 3 | 0.60 | 0.23 |
| 48 | J | 35 | 25 | 29 | 89 | 14 | OK | 4 | 0.52 | 0.22 |
| 49 | K | 31 | 25 | 33 | 89 | 14 | OK | 3 | 0.54 | 0.22 |
| 50 | L | 37 | 25 | 28 | 90 | 12 | OK | 5 | 0.53 | 0.22 |
| 51 | M | 41 | 17 | 35 | 93 | 14 | OK | 5 | 0.59 | 0.23 |
| 52 | N | 31 | 25 | 35 | 91 | 12 | OK | 4 | 0.58 | 0.21 |
| 53 | | 35 | 30 | 28 | 93 | 11 | OK | 5 | 0.56 | 0.23 |
| 54 | | 32 | 31 | 34 | 97 | 9 | OK | 5 | 0.58 | 0.22 |
| 55 | | 36 | 47 | 8 | 91 | 9 | NG | 6 | 0.39 | 0.27 |
| 56 | O | 38 | 22 | 32 | 92 | 15 | OK | 5 | 0.52 | 0.23 |
| 57 | | 37 | 25 | 29 | 91 | 15 | OK | 5 | 0.55 | 0.24 |
| | | 40 | 19 | 35 | 94 | 14 | OK | 5 | 0.58 | 0.21 |
| 59 | P | 38 | 28 | 27 | 93 | 15 | OK | 4 | 0.48 | 0.23 |
| 60 | | 39 | 32 | 21 | 92 | 15 | OK | 5 | 0.48 | 0.25 |
| 61 | | 30 | 21 | 38 | 89 | 14 | OK | 5 | 0.58 | 0.23 |
| 62 | | 34 | 44 | 3 | 81 | 14 | NG | 5 | 0.48 | 0.28 |
| 63 | O | 45 | 21 | 29 | 95 | 13 | OK | 6 | 0.53 | 0.23 |
| 64 | R | 25 | 25 | 39 | 89 | 15 | OK | 5 | 0.51 | 0.21 |
| 65 | S | 44 | 18 | 26 | 88 | 14 | OK | 12 | 0.46 | 0.24 |
| 66 | T | 45 | 22 | 25 | 92 | 13 | OK | 6 | 0.57 | 0.23 |
| 67 | U | 41 | 26 | 28 | 95 | 13 | OK | 8 | 0.51 | 0.23 |
| 68 | V | 39 | 19 | 28 | 86 | 14 | OK | 2 | 0.45 | 0.28 |
| 69 | W | 48 | 16 | 33 | 97 | 3 | OK | 5 | 0.53 | 0.21 |
| 70 | X | 25 | 31 | 41 | 97 | 4 | OK | 5 | 0.55 | 0.22 |
| 71 | Y | 67 | 9 | 14 | 90 | 4 | OK | 13 | 0.51 | 0.25 |
| 72 | Z | 43 | 14 | 33 | 90 | 14 | OK | 4 | 0.51 | 0.23 |

TABLE 6

| | | Material Properties | | | | | | | |
|---|---|---|---|---|---|---|---|---|---|
| No. | Steel Type | TS (MPa) | EL (%) | Low-Temp Toughness (%) | λ (%) | R (mm) | Erichsen Value (mm) | Remarks | Comprehensive Evaluation |
| 1 | A | 845 | 26 | 0 | 42 | 0.0 | 10.8 | 780 MPa Level | Excellent |
| 2 | | 996 | 19 | 0 | 37 | 0.5 | 10.4 | 980 MPa Level | Excellent |
| 3 | | 1022 | 15 | 0 | 38 | 0.5 | 9.8 | 980 MPa Level | Not Good |
| 4 | | 1075 | 14 | 0 | 73 | 0.0 | 10.0 | 980 MPa Level | Not Good |
| 5 | | 997 | 20 | 65 | 13 | 0.5 | 10.2 | 980 MPa Level | Not Good |
| 6 | | 981 | 21 | 0 | 36 | 0.0 | 10.2 | 980 MPa Level | Excellent |
| 7 | | 832 | 27 | 45 | 26 | 1.5 | 10.0 | 780 MPa Level | Not Good |
| 8 | B | 1032 | 25 | 0 | 38 | 0.5 | 10.5 | 980 MPa Level | Excellent |
| 9 | | 1041 | 24 | 0 | 37 | 0.5 | 10.3 | 980 MPa Level | Excellent |
| 10 | | 1018 | 24 | 0 | 27 | 1.0 | 10.3 | 980 MPa Level | Excellent |
| 11 | | 1197 | 15 | 0 | 46 | 0.0 | 10.1 | 1180 MPa Level | Excellent |
| 12 | | 1089 | 13 | 0 | 13 | 3.5 | 9.8 | 980 MPa Level | Not Good |
| 13 | | 1008 | 25 | 0 | 38 | 0.0 | 10.4 | 980 MPa Level | Excellent |
| 14 | | 1057 | 24 | 90 | 15 | 2.0 | 9.9 | 980 MPa Level | Not Good |
| 15 | | 1070 | 19 | 0 | 43 | 0.5 | 9.8 | 980 MPa Level | Good |
| 16 | | 998 | 20 | 80 | 18 | 2.5 | 10.1 | 980 MPa Level | Not Good |
| 17 | C | 1015 | 24 | 0 | 27 | 1.0 | 10.3 | 980 MPa Level | Excellent |
| 18 | | 1024 | 19 | 0 | 40 | 0.0 | 10.2 | 980 MPa Level | Excellent |
| 19 | | 991 | 25 | 0 | 29 | 1.0 | 10.5 | 980 MPa Level | Excellent |
| 20 | | 1000 | 24 | 0 | 24 | 1.0 | 10.3 | 980 MPa Level | Excellent |
| 21 | | 1020 | 24 | 0 | 38 | 0.0 | 10.4 | 980 MPa Level | Excellent |
| 22 | | 926 | 15 | 0 | 31 | 2.0 | 9.9 | 780 MPa Level | Not Good |
| 23 | | 1059 | 20 | 50 | 18 | 1.0 | 9.9 | 980 MPa Level | Not Good |
| 24 | | 872 | 18 | 0 | 41 | 0.0 | 9.8 | 780 MPa Level | Not Good |
| 25 | | 1033 | 24 | 0 | 37 | 0.5 | 10.3 | 980 MPa Level | Excellent |
| 26 | | 1226 | 16 | 0 | 45 | 1.5 | 10.0 | 1180 MPa Level | Excellent |
| 27 | D | 1303 | 14 | 0 | 45 | 2.0 | 9.6 | 1270 MPa Level | Excellent |
| 28 | | 1242 | 17 | 0 | 33 | 1.0 | 10.1 | 1180 MPa Level | Excellent |
| 29 | | 1056 | 19 | 0 | 43 | 0.0 | 10.2 | 980 MPa Level | Excellent |
| 30 | | 994 | 19 | 85 | 22 | 0.5 | 9.8 | 980 MPa Level | Not Good |
| 31 | | 1102 | 18 | 5 | 52 | 0.5 | 9.9 | 980 MPa Level | Not Good |
| 32 | | 1017 | 18 | 0 | 33 | 0.5 | 9.9 | 980 MPa Level | Not Good |

TABLE 6-continued

| No. | Steel Type | Material Properties TS (MPa) | EL (%) | Low-Temp Toughness (%) | λ (%) | R (mm) | Erichsen Value (mm) | Remarks | Comprehensive Evaluation |
|---|---|---|---|---|---|---|---|---|---|
| 33 | | 1015 | 20 | 65 | 19 | 0.5 | 9.8 | 980 MPa Level | Not Good |
| 34 | E | 1237 | 18 | 0 | 28 | 2.5 | 10.0 | 1180 MPa Level | Excellent |
| 35 | | 1263 | 16 | 0 | 52 | 1.0 | 9.8 | 1180 MPa Level | Excellent |
| 36 | | 1291 | 9 | 0 | 52 | 0.5 | 9.5 | 1270 MPa Level | Not Good |
| 37 | | 1212 | 19 | 0 | 33 | 1.5 | 10.0 | 1180 MPa Level | Excellent |
| 38 | | 1053 | 24 | 0 | 40 | 1.0 | 10.4 | 980 MPa Level | Excellent |
| 39 | | 1454 | 8 | 30 | 4 | 4.0 | 9.2 | — | Not Good |
| 40 | F | 1226 | 19 | 0 | 26 | 2.0 | 10.1 | 1180 MPa Level | Excellent |
| 41 | | 1023 | 15 | 5 | 47 | 1.0 | 10.2 | 980 MPa Level | Not Good |
| 42 | | 1486 | 6 | 45 | 8 | 4.0 | 9.4 | — | Not Good |
| 43 | G | 1043 | 24 | 0 | 38 | 1.0 | 10.3 | 980 MPa Level | Excellent |
| 44 | | 996 | 24 | 40 | 48 | 0.0 | 10.6 | 980 MPa Level | Not Good |

TABLE 7

| No. | Steel Type | Material Properties TS (MPa) | EL (%) | Low-Temp Toughness (%) | λ (%) | R (mm) | Erichsen Value (mm) | Remarks | Comprehensive Evaluation |
|---|---|---|---|---|---|---|---|---|---|
| 45 | H | 1021 | 25 | 0 | 34 | 0.5 | 10.4 | 980 MPa Level | Excellent |
| 46 | | 989 | 19 | 65 | 15 | 2.5 | 10.4 | 980 MPa Level | Not Good |
| 47 | I | 1055 | 24 | 0 | 34 | 1.0 | 10.5 | 980 MPa Level | Excellent |
| 48 | J | 1042 | 23 | 0 | 44 | 1.0 | 10.3 | 980 MPa Level | Excellent |
| 49 | K | 1008 | 24 | 0 | 32 | 1.0 | 10.4 | 980 MPa Level | Excellent |
| 50 | L | 992 | 22 | 0 | 43 | 1.0 | 10.2 | 980 MPa Level | Excellent |
| 51 | M | 1067 | 23 | 0 | 31 | 1.5 | 10.2 | 980 MPa Level | Excellent |
| 52 | N | 1219 | 18 | 0 | 42 | 1.5 | 10.0 | 1180 MPa Level | Excellent |
| 53 | | 1210 | 17 | 0 | 42 | 1.5 | 10.0 | 1180 MPa Level | Excellent |
| 54 | | 1232 | 15 | 0 | 47 | 1.5 | 9.9 | 1180 MPa Level | Excellent |
| 55 | | 1189 | 16 | 85 | 19 | 3.5 | 9.7 | 1180 MPa Level | Not Good |
| 56 | O | 1039 | 25 | 0 | 37 | 1.0 | 10.4 | 980 MPa Level | Excellent |
| 57 | | 1026 | 25 | 0 | 35 | 0.5 | 10.5 | 980 MPa Level | Excellent |
| 58 | | 982 | 26 | 0 | 32 | 1.0 | 10.5 | 980 MPa Level | Excellent |
| 59 | P | 1047 | 24 | 0 | 35 | 1.0 | 10.4 | 980 MPa Level | Excellent |
| 60 | | 1003 | 26 | 0 | 35 | 0.5 | 10.5 | 980 MPa Level | Excellent |
| 61 | | 1018 | 24 | 0 | 43 | 1.0 | 10.2 | 980 MPa Level | Excellent |
| 62 | | 1116 | 19 | 90 | 18 | 3.5 | 9.5 | 980 MPa Level | Not Good |
| 63 | Q | 1004 | 21 | 0 | 55 | 0.5 | 10.4 | 980 MPa Level | Excellent |
| 64 | R | 1071 | 25 | 0 | 31 | 1.0 | 10.3 | 980 MPa Level | Excellent |
| 65 | S | 1027 | 21 | 0 | 38 | 1.0 | 10.3 | 980 MPa Level | Excellent |
| 66 | T | 1044 | 23 | 0 | 41 | 1.0 | 10.4 | 980 MPa Level | Excellent |
| 67 | U | 1074 | 22 | 0 | 44 | 1.0 | 10.3 | 980 MPa Level | Excellent |
| 68 | V | 1046 | 22 | 85 | 28 | 2.0 | 10.4 | 980 MPa Level | Not Good |
| 69 | W | 885 | 20 | 0 | 38 | 0.0 | 10.2 | 780 MPa Level | Not Good |
| 70 | X | 922 | 19 | 0 | 43 | 0.0 | 10.0 | 780 MPa Level | Not Good |
| 71 | Y | 784 | 18 | 5 | 61 | 0.0 | 9.8 | 780 MPa Level | Not Good |
| 72 | Z | 1021 | 24 | 0 | 26 | 1.0 | 10.4 | 980 MPa Level | Excellent |

The following can be considered from the above results. Any of the examples for which good is given in the comprehensive evaluation of Tables 6 and 7 is an example satisfying the requirements specified in the present invention and satisfies reference values of elongation (EL) and low-temperature toughness determined according to each tensile strength (TS). Further, any of Examples for which excellent is given in the comprehensive evaluation is an example satisfying also preferable requirements specified in the present invention and satisfies reference values of stretch flange formability (λ), bendability (R) and the Erichsen value in addition to those of elongation (EL) and low-temperature toughness according to each tensile strength (TS).

On the other hand, any of the examples for which not good is given in the comprehensive evaluation is a steel sheet not satisfying any of the requirements specified in the present invention. The details are as follows.

In No. 3, the amount of retained γ could not be ensured and elongation (EL) was low since the rapid cooling stop temperature T and the end temperature in the T1 temperature region were too low.

In No. 4, polygonal ferrite was not generated and elongation (EL) was low since the soaking temperature was too high.

No. 5 is an example in which the steel sheet was held at 320° C. on the low temperature side below the T1 temperature region after being held at 420° C. on the high temperature side above the T2 temperature region after soaking. Specifically, a desired IQ distribution satisfying the above Equations (1) and (2) was not obtained and low-temperature toughness was poor since the steel sheet was not held in the T1 temperature region and the T2 temperature region.

In No. 7, a desired IQ distribution satisfying the above Equations (1) and (2) was not obtained and low-temperature toughness was poor since the rapid cooling stop temperature T and the end temperature in the T1 temperature region were too high.

In No. 12, the amount of polygonal ferrite in which a large amount of the worked structure remained increased and elongation (EL) was reduced since the soaking temperature was too low and reverse transformation into austenite hardly progressed.

No. 14 is an example in which the steel sheet was held at 380° C. on the low temperature side below the T2 temperature region after being held at 440° C. on the high temperature side above T1 temperature region after soaking. Specifically, a desired IQ distribution satisfying the above Equations (1) and (2) was not obtained and low-temperature toughness was poor since the steel sheet was neither held in the T1 temperature region nor reheated in the T2 temperature region after cooling.

In No. 16, a desired IQ distribution satisfying the above Equations (1) and (2) was not obtained and low-temperature toughness was poor since the rapid cooling stop temperature T and the end temperature in the T1 temperature region were too high.

In No. 22, a large amount of ferrite remained and the polygonal ferrite area percent to the metal structure was high since the soaking time was too short. Further, the amount of retained γ was small since carbide remained in a non-solid solution state. Thus, elongation (EL) was reduced.

In No. 23, a desired IQ distribution satisfying the above Equations (1) and (2) was not obtained and low-temperature toughness was poor since the rapid cooling stop temperature T was higher than the Ms point.

No. 24 is an example in which the average cooling rate during cooling up to the arbitrary temperature T in the T1 temperature region after soaking was too slow. In this example, polygonal ferrite and perlite were generated during cooling and the amount of retained γ was insufficient. Thus, elongation (EL) was reduced.

In No. 30, a desired IQ distribution satisfying the above Equations (1) and (2) was not obtained and low-temperature toughness was poor since the holding time in the T1 temperature region was too short.

In No. 31, the amount of retained γ could not be ensured and elongation (EL) was reduced since the holding time in the T1 temperature region was long and the holding temperature in the T2 temperature region was too low.

No. 32 is a comparative example of the GA steel sheet, and the amount of retained γ could not be ensured and elongation (EL) was reduced since the rapid cooling stop temperature T and the end temperature in the T1 temperature region were too low.

In No. 33, a desired IQ distribution satisfying the above Equations (1) and (2) was not obtained and low-temperature toughness was poor since the rapid cooling stop temperature T was higher than the Ms point.

In No. 36, the amount of retained γ was insufficient since the holding time in the T1 temperature region was too long. Thus, elongation (EL) was reduced.

In No. 39, a desired IQ distribution satisfying the above Equation (1) was not obtained and low-temperature toughness was poor since the holding time in the T2 temperature region was too short.

In No. 41, the amount of retained γ decreased and elongation (EL) was reduced since the holding temperature in the T2 temperature region was too high and perlite was generated.

In No. 42, a desired IQ distribution satisfying the above Equation (1) was not obtained and low-temperature toughness was poor since the holding time in the T2 temperature region was too short.

In No. 44, a desired IQ distribution satisfying the above Equation (2) was not obtained and low-temperature toughness was poor since the reheating treatment in the T2 temperature region was not performed.

In Nos. 46 and 55, a desired IQ distribution satisfying the above Equations (1) and (2) was not obtained and low-temperature toughness was poor since the holding time in the T1 temperature region was too short.

No. 62 is an example in which the steel sheet was cooled up to the room temperature after being held at 430° C. on the high temperature side above the T1 temperature region after soaking. A desired IQ distribution satisfying the above Equation (2) was not obtained and low-temperature toughness was poor since the steel sheet was neither held in the T1 temperature region nor reheated in the T2 temperature region after cooling.

No. 68 is an example in which the steel sheet was held at 350° C. on the low temperature side below the T2 temperature region after being held at 450° C. to 420° C. on the high temperature side above the T1 temperature region after soaking. A desired IQ distribution satisfying the above Equation (2) was not obtained and low-temperature toughness was poor since the steel sheet was neither held in the T1 temperature region nor reheated in the T2 temperature region after cooling.

No. 69 is an example using the steel type W of Table 1 with an excessively small amount of C. In this example, the generation amount of retained γ was small. Thus, elongation (EL) was reduced.

No. 70 is an example using the steel type X of Table 1 with an excessively small amount of Si. In this example, the generation amount of retained γ was small. Thus, elongation (EL) was reduced.

No. 71 is an example using the steel type Y of Table 1 with an excessively small amount of Mn. In this example, a large amount of polygonal ferrite was generated during cooling, the generation of high-temperature region generated bainite was suppressed and the generation of retained γ was reduced since sufficient quenching was not performed. Thus, elongation (EL) was reduced.

LIST OF REFERENCE SIGNS

1 retained γ and/or carbide
2 distance between center positions
3 MA mixed phase
4 former γ grain boundary
5 high-temperature region generated bainite
6 low-temperature region generated bainite and the like

The invention claimed is:

1. A high-strength steel sheet, comprising, in mass %:
C: 0.10 to 0.5;
Si: 1.0 to 3.0%;
Mn: 1.5 to 3%;
Al: 0.005 to 1.0%;
P: more than 0% and not more than 0.1%;
S: more than 0% and not more than 0.05%;
iron; and
inevitable impurities, wherein:

a metal structure of the steel sheet comprises polygonal ferrite, bainite, tempered martensite and retained austenite; and the metal structure satisfies the following conditions:

(1) when the metal structure is observed by a scanning electron microscope, (1a) an area percent a of the polygonal ferrite to the entire metal structure is 10 to 50%;

(1b) the bainite comprises a composite structure of high-temperature region generated bainite in which an average interval of distances between center positions of adjacent retained austenite grains, of adjacent carbide grains and of adjacent retained austenite grains and carbide grains is 1 μm or longer and low-temperature region generated bainite in which an average interval of distances between center positions of adjacent retained austenite grains, of adjacent carbide grains and of adjacent retained austenite grains and carbide grains is shorter than 1 μm:

an area percent b of the high-temperature region generated bainite to the entire metal structure satisfies higher than 0% and not higher than 80%, and a total area percent c of the low-temperature region generated bainite and the tempered martensite to the entire metal structure satisfies higher than 0% and not higher than 80%;

(2) a volume percent of the retained austenite measured by a saturation magnetization method to the entire metal structure is 5% or higher; and (3) when an area enclosed by a boundary in which an orientation difference measured by electron backscatter diffraction (EBSD) is 3° or larger is defined as a crystal grain, a distribution using each average IQ (Image Quality) based on the visibility of an EBSD pattern of the crystal grain analyzed for each crystal grain of a body centered cubic lattice (including a body centered tetragonal lattice) satisfies Equations (1) and (2) below:

$$(IQave-IQmin)/(IQmax-IQmin)\geq 0.40 \quad (1)$$

$$(\sigma IQ)/(IQmax-IQmin)\leq 0.25 \quad (2)$$

in which

IQave denotes an average value of average IQ total data of each crystal grain,

IQmin denotes a minimum value of average IQ total data of each crystal grain,

IQmax denotes a maximum value of average IQ total data of each crystal grain, and σIQ denotes a standard deviation of the average IQ total data of each crystal grain.

2. The high-strength steel sheet according to claim 1, wherein:

the area percent b of the high-temperature region generated bainite to the entire metal structure satisfies 10 to 80%; and the total area percent c of the low-temperature region generated bainite and the tempered martensite to the entire metal structure satisfies 10 to 80%.

3. The high-strength steel sheet according to claim 1, wherein, if MA mixed phases in which quenched martensite and retained austenite are compounded are present when the metal structure is observed by an optical microscope, a number ratio of the MA mixed phases having a circle-equivalent diameter d satisfying 7 μm or larger to the total number of the MA mixed phases is higher than 0% and below 15%.

4. The high-strength steel sheet according to claim 1, wherein an average circle-equivalent diameter D of the polygonal ferrite grains is larger than 0 μm and not larger than 10 μm.

5. The high-strength steel sheet according to claim 1, further comprising at least one of (a) to (e):

(a) one or more elements selected from the group consisting of Cr: more than 0% and not more than 1% and Mo: more than 0% and not more than 1%, (b) one or more elements selected from the group consisting of Ti: more than 0% and not more than 0.15%, Nb: more than 0% and not more than 0.15% and V: more than 0% and not more than 0.15%, (c) one or more elements selected from the group consisting of Cu: more than 0% and not more than 1% and Ni: more than 0% and not more than 1%, (d) B: more than 0% and not more than 0.005%, and (e) one or more elements selected from the group consisting of Ca: more than 0% and not more than 0.01%, Mg: more than 0% and not more than 0.01% and rare-earth elements: more than 0% and not more than 0.01%.

6. The high-strength steel sheet according to claim 1, wherein a surface of the steel sheet includes an electro-galvanized layer, a hot dip galvanized layer or an alloyed hot dip galvanized layer.

7. A method for producing the high-strength steel sheet of claim 1, the method comprising:

heating the steel sheet to a temperature region of 800° C. or higher and an $Ac_3$ point—10° C. or lower;

soaking the steel sheet in this temperature region for 50 seconds or longer; then cooling the steel sheet at an average cooling rate of 10° C./s or higher up to a temperature T satisfying 150° C. or higher and 400° C. or lower (an Ms point or lower if the Ms point expressed by Equation below is 400° C. or lower) and holding the steel sheet in a T1 temperature region satisfying Equation (3) below for 10 to 200 seconds; and subsequently heating the steel sheet to a T2 temperature region satisfying Equation (4) below and cooling the steel sheet after holding the steel sheet in this temperature region for 50 seconds or longer:

$$150°\ C.\leq T1(°\ C.)\leq 400°\ C. \quad (3),$$

$$400°\ C.<T2(°\ C.)\leq 540°\ C. \quad (4),$$

$$Ms\ point\ (°\ C.)=561-474\times[C]/(1-Vf/100)-33\times[Mn]-17\times[Ni]-17\times[Cr]-21\times[Mo]$$

wherein:

Vf denotes a ferrite fraction measurement value in a sample replicating an annealing pattern from heating, soaking to cooling which is separately fabricated; and

[ ] in Equation indicates a content (mass %) of each element and the content of the element not contained in the steel sheet is calculated as 0 mass %.

8. The method of claim 7, wherein cooling and, subsequently, electro-galvanizing, hot dip galvanizing or alloyed hot dip galvanizing are applied after the steel sheet is held in the temperature region satisfying the Equation (4).

9. The method of claim 7, wherein hot dip galvanizing or alloyed hot dip galvanizing is applied in the temperature region satisfying the Equation (4).

* * * * *